US008606168B2

(12) United States Patent
Murakami et al.

(10) Patent No.: US 8,606,168 B2
(45) Date of Patent: Dec. 10, 2013

(54) IMAGE FORMING APPARATUS

(75) Inventors: Yusuke Murakami, Toyokawa (JP); Shigeki Nozawa, Toyokawa (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 274 days.

(21) Appl. No.: 13/236,018

(22) Filed: Sep. 19, 2011

(65) Prior Publication Data

US 2012/0070215 A1 Mar. 22, 2012

(30) Foreign Application Priority Data

Sep. 21, 2010 (JP) ..... 2010-210917

(51) Int. Cl.
*B41J 29/38* (2006.01)
*B65H 29/60* (2006.01)

(52) U.S. Cl.
USPC ..... 399/405; 399/401; 399/407

(58) Field of Classification Search
CPC ..... G03G 15/6573; G03G 2215/00666; G03G 21/206; G03G 2221/1645; G03G 2215/00772; B41J 13/0036
USPC ..... 399/405, 401, 397, 94
See application file for complete search history.

(56) References Cited

U.S. PATENT DOCUMENTS

2003/0156850 A1* 8/2003 Tsutada ..... 399/45
2004/0095451 A1* 5/2004 Tatsumi et al. ..... 347/101
2006/0291874 A1* 12/2006 Kyung ..... 399/16
2008/0044213 A1 2/2008 Kato et al.
2008/0181688 A1 7/2008 Kurita

FOREIGN PATENT DOCUMENTS

| | | | |
|---|---|---|---|
| JP | 5-330691 | A | 12/1993 |
| JP | 11-021010 | A | 1/1999 |
| JP | 2004-291654 | A | 10/2004 |
| JP | 2005-077565 | A | 3/2005 |
| JP | 2006-091627 | A | 4/2006 |
| JP | 2006-103849 | A | 4/2006 |
| JP | 2006-145685 | A | 6/2006 |

(Continued)

OTHER PUBLICATIONS

Office Action (Notification of Reasons for Refusal) dated Sep. 11, 2012, issued in corresponding Japanese Patent Application No. 2010-210917, and an English Translation thereof (with Verification of Translation). (6 pages).

*Primary Examiner* — Ren Yan
*Assistant Examiner* — Ruben Parco, Jr.
(74) *Attorney, Agent, or Firm* — Buchanan Ingersoll & Rooney PC

(57) ABSTRACT

An image forming apparatus comprises: a pair of first sheet ejecting rollers and a pair of second sheet ejecting rollers that eject a sheet on which an image is formed; a guide member that guides the sheet to the pair of first sheet ejecting rollers or the pair of second sheet ejecting rollers; a controller that performs control so that, while a sheet that is to be ejected by the pair of first sheet ejecting rollers onto an ejected-sheet tray is being held by the pair of first sheet ejecting rollers in a stopped state, the pair of second sheet ejecting rollers is in a stopped state and hold an immediately subsequent sheet above the ejected-sheet tray; and a fan that moves air toward the sheet held by the pair of first sheet ejecting rollers and the immediately subsequent sheet held by the pair of second sheet ejecting rollers.

9 Claims, 13 Drawing Sheets

(56) References Cited

FOREIGN PATENT DOCUMENTS

| | | | | | |
|---|---|---|---|---|---|
| JP | 2007-045553 | A | | 2/2007 | |
| JP | 2007-248765 | A | | 9/2007 | |
| JP | 2008-046576 | A | | 2/2008 | |
| JP | 2008-112103 | A | | 5/2008 | |
| JP | 2008-181022 | A | | 8/2008 | |
| JP | 2008299291 | A | * | 12/2008 | ..... G03G 21/14 |
| JP | 2010-049005 | A | | 3/2010 | |
| JP | 2010-076290 | A | | 4/2010 | |

* cited by examiner

| | | |
|---|---|---|
| Odd-numbered recording sheet | $To=\{Lp+(2\times Lgp)\}\div Sp+\alpha$ | 2.1 seconds |
| Even-numbered recording sheet | $Te=(L1-L2+Lp+Lgp)\div Sp+\alpha$ | 1.8 seconds |

FIG. 14

| Temperature of sheet immediately after passing through fixing device | Reserved stopped time period: 1.5-2 seconds | | | Reserved stopped time period: 2-2.5 seconds | | | Reserved stopped time period: 2.5-4.5 seconds | | | Reserved stopped time period: more than 4.5 seconds | | |
|---|---|---|---|---|---|---|---|---|---|---|---|---|
| | Coverage ratio is equal to or less than 20 % | Coverage ratio is more than 20 % | Heavy sheet | Coverage ratio is equal to or less than 20 % | Coverage ratio is more than 20 % | Heavy sheet | Coverage ratio is equal to or less than 20 % | Coverage ratio is more than 20 % | Heavy sheet | Coverage ratio is equal to or less than 20 % | Coverage ratio is more than 20 % | Heavy sheet |
| 75～80 | 50% | 70% | 90% | 40% | 60% | 80% | 30% | 50% | 70% | 10% | 30% | 50% |
| 70～75 | 30% | 50% | 70% | 20% | 40% | 60% | 10% | 30% | 50% | – | 10% | 30% |
| 65～70 | 10% | 30% | 50% | – | 20% | 40% | – | 10% | 30% | – | – | – |
| 60～65 | – | 10% | 30% | – | – | 20% | – | – | – | – | – | – |
| 55～60 | – | – | 10% | – | – | – | – | – | – | – | – | – |
| 50～55 | – | – | – | – | – | – | – | – | – | – | – | – |

FIG. 17

| | | |
|---|---|---|
| Circulation path housing one recording sheet | $T1=\{Lp+(2\times Lgp)+La\}\div Sp+Te+\alpha$ | 8.9 seconds |
| Circulation path housing two recording sheets | $T2=0.56\times T1+\alpha$ | 5 seconds |
| Circulation path housing three recording sheets | $T3=0.42\times T1+\alpha$ | 3.7 seconds |

IMAGE FORMING APPARATUS

This application is based on application No. 2010-210917 filed in Japan, the contents of which are hereby incorporated by reference.

BACKGROUND OF THE INVENTION (1) Field of the Invention

The present invention relates to an image forming apparatus that forms an image on recording sheets, and in particular to a drying technique to dry a developer such as toner and ink that constitute the image formed on the recording sheets.

(2) Description of the Related Art

An image forming apparatus (e.g., a copying machine or a printer) that forms a toner image by an electrophotographic method normally transfers the toner image formed on a photosensitive drum onto a recording sheet, and then fixes the toner image by a fixing device. The fixing device heats the toner image on the recording sheet and applies pressure on the recording sheet to fix the toner image. The recording sheet on which the toner image has been fixed is ejected on an ejected-sheet tray.

The recording sheet is placed onto the ejected-sheet tray with a side on which the toner image has been formed facing down on the ejected-sheet tray. When toner images are successively formed on a plurality of recording sheets, the recording sheets are sequentially placed on the ejected-sheet tray with the toner images facing down.

The toner image on each recording sheet is fused at the fixing device, and then dried while the recording sheet is transferred from the fixing device and ejected onto the ejected-sheet tray. However, if the toner image on the recording sheet ejected onto the ejected-sheet tray is not completely dried, the toner image on the recording sheet placed on the ejected-sheet tray might adhere to another recording sheet placed thereunder. A problem that recording sheets adhere to each other with toner is normally called "fixing tacking".

Such fixing tacking is more likely to occur, for example, when a temperature of a recording sheet after fixation is high, when an ambient temperature of the fixing device is high, and when an ambient temperature around the image forming apparatus is high. This is because a drying speed of toner becomes slow.

Also, when duplex printing for forming toner images on both sides of a recording sheet is performed, fixing tacking is more likely to occur since toner images exist on opposite sides facing each other of recording sheets layered on the ejected-sheet tray. Furthermore, when a basis weight of a recording sheet is large, fixing tacking is more likely to occur since toner on an upper recording sheet is pressed with a high pressure against a recording sheet that is positioned under the upper recording sheet with its own weight.

Also, when a coverage ratio that is a ratio of a toner image to a surface of a recording sheet is high, an amount of toner is large and therefore fixing tacking is more likely to occur.

Moreover, when a speed (system speed) of transportation of recording sheets becomes high in successively performing image formation, intervals of transportation of recording sheets ejected onto the ejected-sheet tray become short. Therefore, a recording sheet might be placed on a preceding recording sheet before a toner image on the recording sheet has not completely dried. As a result, fixing tacking is more likely to occur.

Patent Literature 1 (Japanese Unexamined Patent Application Publication No. 2004-291654) discloses a structure for drying ink in an inkjet recording apparatus that can perform duplex printing, according to which a rear end portion of a recording sheet is sandwiched between a switch back roller and a switch back runner while ink is drying.

Also, Patent Literature 2 (Japanese Unexamined Patent Application Publication No. 2006-103849) discloses an ink jet image forming apparatus that forms an image on a recording medium by an ink jet printing system and then dries ink by a blast fan while temporarily holding the recording medium with use of a sheet ejecting roller.

According to the structure disclosed in Patent Literature 1, in duplex printing, printing on one side of a recording sheet must be performed after ink on the other side of the recording sheet dries. This results in reduction of printing efficiency.

Also, according to the structure disclosed in Patent Literature 2, printing efficiency decreases since printing cannot be performed while the sheet ejecting roller is holding the recording medium and the blast fan is drying the recording medium. Moreover, if an amount of air moved by the blast fan is increased so as to dry ink faster, consumed electric power increases, and at the same time, a loud noise might occur.

Note that in order to prevent reduction of printing efficiency, Patent Literature 2 discloses a structure according to which two or more sheet ejecting paths are provided and a recording medium that does not need to have ink dried by being held by the sheet ejecting roller overtakes a preceding recording medium and is ejected onto the ejected-sheet tray. However, with such a structure, an order of recording mediums ejected onto the ejected-sheet tray changes, and accordingly a user has to rearrange the order of the ejected recording mediums.

SUMMARY OF THE INVENTION

The present invention is provided in view of the above problems, and aims to provide an image forming apparatus that (i) can efficiently dry an image on a recording sheet that is to be ejected onto the ejected-sheet tray without reduction of printing efficiency and economic efficiency and (ii) does not require rearrangement of an order of recording sheets that are ejected onto the ejected-sheet tray.

In order to achieve the above aims, an image forming apparatus of the present invention including an image processing unit and an ejected-sheet tray comprises: a pair of first sheet ejecting rollers and a pair of second sheet ejecting rollers that eject, onto the ejected-sheet tray, a recording sheet on which an image is formed by the image processing unit with use of a developer, the pair of second sheet ejecting rollers being positioned above the pair of first sheet ejecting rollers; a guide member that selectively guides the recording sheet to the pair of first sheet ejecting rollers or the pair of second sheet ejecting rollers; a controller that controls the pair of first sheet ejecting rollers, the pair of second sheet ejecting rollers, and the guide member so that, while a recording sheet that is to be ejected by the pair of first sheet ejecting rollers onto the ejected-sheet tray is being held by the pair of first sheet ejecting rollers in a stopped state, the pair of second sheet ejecting rollers is in a stopped state and hold an immediately subsequent recording sheet transported from the image processing unit above the ejected-sheet tray; and a fan that moves air past the pair of first sheet ejecting rollers and the pair of second sheet ejecting rollers toward the recording sheet held by the pair of first sheet ejecting rollers and the immediately subsequent recording sheet held by the pair of second sheet ejecting rollers.

BRIEF DESCRIPTION OF THE DRAWINGS

These and the other objects, advantages and features of the invention will become apparent from the following description thereof taken in conjunction with the accompanying drawings which illustrate specific embodiments of the present invention.

In the drawings:

FIG. 14 shows an example of a table indicating a rotational speed, the table being used to determine a rotational speed of a fan in the fan rotational speed determining control;

FIG. 17 is a table showing examples of methods for calculating the stopped time period and calculation results in the stopped time period determining control.

DESCRIPTION OF THE PREFERRED EMBODIMENT

The following describes an embodiment of an image forming apparatus pertaining to the present invention.

<Structure of Image Forming Apparatus>

Figure 1:
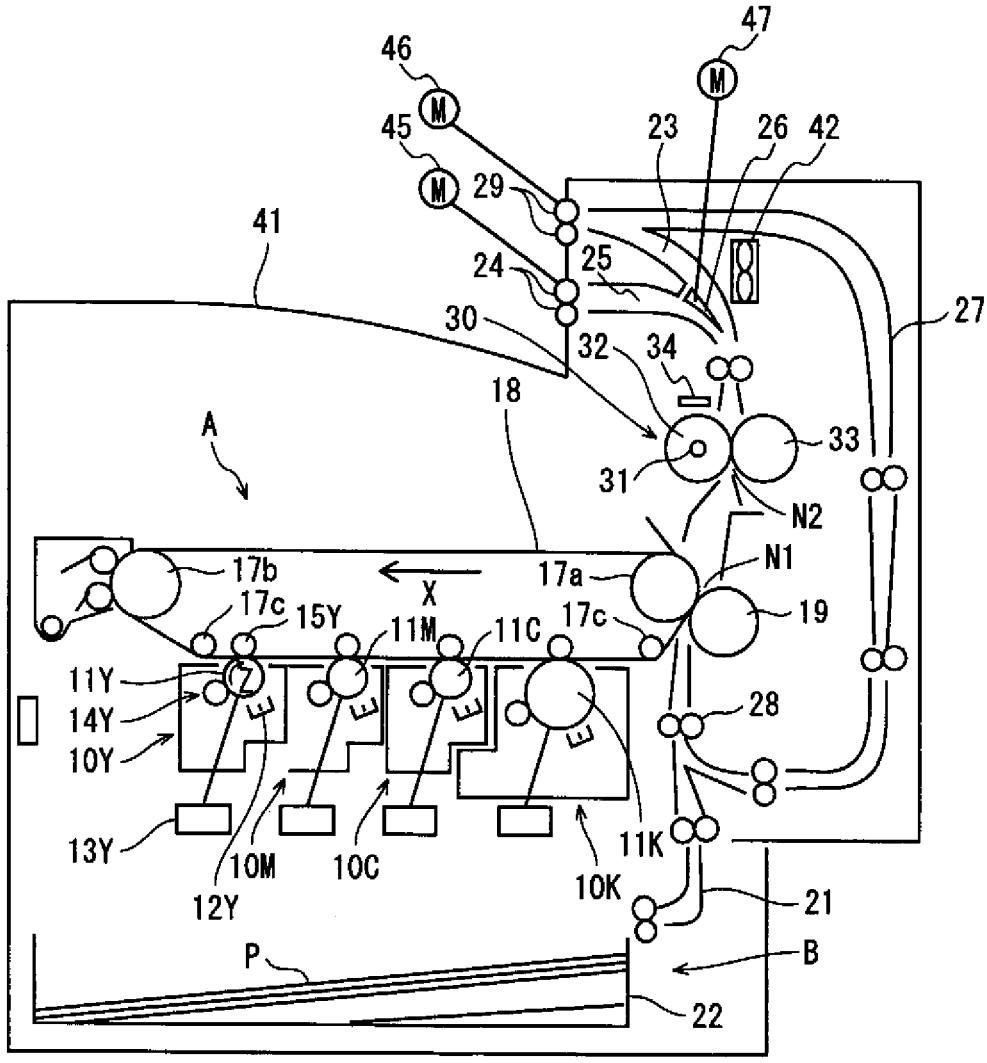
FIG. 1 is a schematic view showing a schematic structure of a tandem type color digital printer, which is an example of an image forming apparatus pertaining to an embodiment of the present invention.

FIG. 1 is a schematic view showing a schematic structure of a tandem type color digital printer (hereinafter, simply referred to "printer"), which is an example of the image forming apparatus pertaining to the embodiment of the present invention. Such a printer forms a toner image on a recording sheet by a known electrophotographic method based on image data and the like that are input from an external terminal apparatus and the like via a network (e.g., LAN).

The printer includes an image processing unit A that performs image formation (printing) and a paper feeder B provided under the image processing unit A. At a substantially central portion of the image processing unit A in a vertical direction, an intermediate transfer belt 18 having an elongated revolving movement area in a horizontal direction is provided. The intermediate transfer 18 winds around a driving roller 17*a*, a driven roller 17*b*, and a pair of tension rollers 17*c*. The intermediate transfer belt 18 revolves in the direction indicated by an arrow X.

Image forming units 10Y, 10M, 10C, and 10K are provided below the intermediate transfer belt 18. The image forming units 10Y, 10M, 10C, and 10K are disposed in the stated order in the direction in which the intermediate transfer belt 18 moves in a revolving motion.

Toners of colors yellow (Y), magenta (M), cyan (C), and black (K) are supplied to and contained in housings of the image forming units 10Y, 10M, 10C, and 10K, respectively. The image forming units 10Y, 10M, 10C, and 10K respectively have photosensitive drums 11Y, 11M, 11C, and 11K that respectively form toner images on surfaces of the photosensitive drums 11Y, 11M, 11C, and 11K.

In the following, only the structure of the image forming unit 10Y is mainly explained, and description of the structures of the other image forming units 10M, 10C, and 10K is omitted since they have substantially the same structure except that they use toners of different colors to form respective toner images.

The photosensitive drum 11Y provided in the image forming unit 10Y is provided rotatably in a direction indicated by an arrow Z under the intermediate transfer belt 18 so as to face the intermediate transfer 18. Under the photosensitive drum 11Y, a charger 12Y is provided to face the photosensitive drum 11Y. A surface of the photosensitive drum 11Y is uniformly charged by the charger 12Y. On the charged surface of the photosensitive drum 11Y, an electrostatic latent image is formed by laser light L projected by a print head 13Y provided under the image forming unit 10Y.

The electrostatic latent image formed on the surface of the photosensitive drum 11Y is developed by a developer 14Y with use of toner of color Y. The developer 14Y includes a developing roller that holds and transports the toner of the color Y. As the developing roller rotates upon receiving application of a developing bias voltage, the toner of the color Y on the developing roller is transported to a position facing the photosensitive drum 11Y, at which the toner of the color Y is attached to the electrostatic latent image having been formed on the surface of the photosensitive drum 11Y. This forms the toner image of the color Yon the surface of the photosensitive drum 11Y.

Within the revolving movement area of the intermediate transfer belt 18, a first transfer roller 15Y is disposed to face the photosensitive drum 11Y via the intermediate transfer belt 18. By an action of an electric field formed by the first transfer roller 15Y to which a transfer bias voltage has been applied, the toner image is primarily transferred from the photosensitive drum 11Y onto the intermediate transfer belt 18.

Note that when a full-color image is to be formed, the timings at which the image forming units 10Y, 10M, 10C, and 10K form the respective images are adjusted so that the toner images are multi-transferred from the photosensitive drums 11Y, 11M, 11C, and 11K to the same area on a surface of the intermediate transfer belt 18.

When a monochrome image is to be formed, only a selected image forming unit (for example, the image forming unit 10K that uses the toner of color K) is driven so that a toner image is formed on the photosensitive drum 11K provided in the image forming unit 10K and transferred therefrom to a predetermined area on the surface of intermediate transfer belt 18.

An end of the intermediate transfer belt 18 which is located in the downstream in the direction in which the toner images thereon are transported (right side in FIG. 1) is wound around a driving roller 17*a*, and a second transfer roller 19 is disposed to face the driving roller 17*a*, via the intermediate transfer belt 18 wound around the driving roller 17*a*. The second transfer roller 19 is in contact with the intermediate transfer belt 18 so that a transfer nip N1 is formed therebetween.

The paper feeder B provided under the image processing unit A includes a paper feeding cassette 22 storing therein a recording sheet P. The recording sheet P stored in the paper feeding cassette 22 is transported along a sheet transport path 21. When the recording sheet P transported along the sheet transport path 21 reaches a pair of resist rollers 28, the pair of resist rollers 28 synchronize the recording sheet P with a revolving movement of the intermediate transfer belt 18 and transport the recording sheet P to the transfer nip N1.

While the recording sheet P passes through the transfer nip N1, the toner image transferred onto the intermediate transfer belt 18 is secondarily transferred onto the recording sheet P by an action of an electric field formed by the second transfer roller 19 to which a transfer bias voltage has been applied. The recording sheet P onto which the toner image has been transferred at the transfer nip N1 is transported to the fixing device 30 placed above the transfer nip N1.

Figure 2:
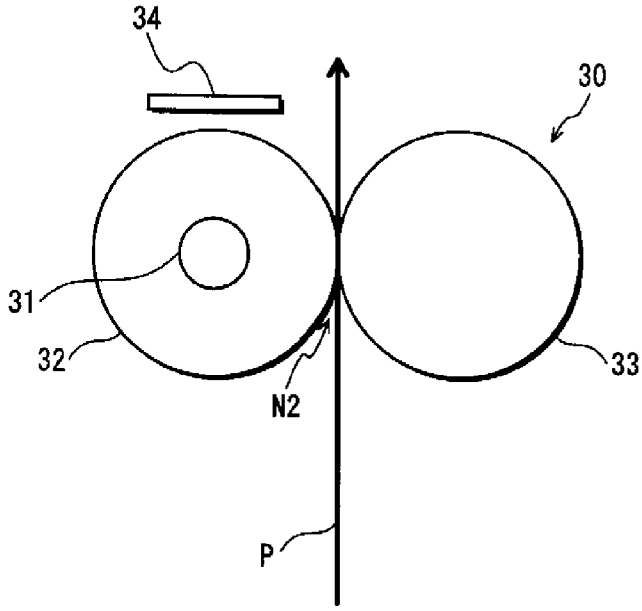
FIG. 2 is a schematic view showing a structure of a fixing device provided to the printer of FIG. 1.

FIG. 2 is a schematic view showing the structure of the fixing device 30. The fixing device 30 includes a heating roller 32 in which a heater lamp 31 is built, and a pressurizing roller 33 pressed against the heating roller 32. A fixing nip N2 is formed between the heating roller 32 and the pressurizing roller 33. When the recording sheet P onto which the toner image has been transferred passes through the fixing nip N2, the toner image is fixed on the recording sheet P by being heated and pressurized.

The fixing device 30 includes a thermistor 34 that is positioned to face an outer circumferential surface of the heating roller 32. The thermistor 34 detects a temperature of the outer circumferential surface of the heating roller 32, and the heater lamp 31 is controlled to remain at a predetermined temperature for fixing (hereinafter, fixing temperature) based on the temperature of the heating roller 32 detected by the thermistor 34.

As shown in FIG. 1, a sheet ejection path 25 is provided at the upper part of the fixing device 30. Through the sheet ejection path 25, the recording sheet that has passed through the fixing device 30 is transported to the ejected-sheet tray 41 that is provided above the image processing unit A. At an end of the sheet ejection path 25 that is closer to the ejected-sheet tray 41, a pair of sheet ejecting rollers 24 are provided so as to face each other. The pair of sheet ejecting rollers 24 eject onto the ejected-sheet tray 41 the recording sheet P that has been transported through the sheet ejection path 25.

The pair of sheet ejecting rollers 24 are rotated by a sheet ejecting motor 45 to eject the recording sheet P that has been transported through the sheet ejection path 25 onto the ejected-sheet tray. The recording sheet P is ejected onto the ejected-sheet tray 41 by passing between the pair of sheet ejecting rollers 24 while the sheet ejecting motor 45 is rotating the pair of sheet ejecting rollers 24.

When printing is successively performed, the sheet ejecting motor 45 stops immediately before a rear end portion of the recording sheet P passes through the pair of sheet ejecting rollers 24. Thereby, the pair of sheet ejecting rollers 24 hold therebetween the rear end portion of the recording sheet P.

The sheet ejection path 25 includes a branch 23 that extends toward a position that is above the pair of sheet ejecting rollers 24. An end of the branch 23 at the downstream in a direction in which the recording sheet P is transported is positioned above the pair of sheet ejecting rollers 24.

A circulation path 27 branches from the branch 23. Through the circulation path 27, the recording sheet P transported from the fixing device 30 is transported to the resist rollers 28 of the image processing unit A so that, when the recording sheet P reaches the resist rollers 28, the recording sheet P is turned over. The circulation path 27 extends vertically along an opposite side of downstream of the sheet ejection path 25 in the transport direction of the recording sheet P with respect to the fixing device 30, and reaches the resist rollers 28.

At an end of the branch 23 that is positioned above the pair of sheet ejecting rollers 24, a pair of circulating rollers 29 are provided. The pair of circulating rollers 29 are rotated in a forward direction and in a reverse direction by a circulation motor 46 that can rotate in the forward direction and in the reverse direction. The pair of circulating rollers 29 are rotated in the forward direction in the case where the recording sheet P transported from the fixing device 30 through the branch 23 is held above the ejected-sheet tray 41, and stopped immediately before the rear end portion of the recording sheet P passes therethrough. Thereby, the rear end portion of the recording sheet P is held by the pair of circulating rollers 29. After that, the pair of circulating rollers 29 rotate in the reverse direction, and accordingly the recording sheet P is transported to the circulation path 27.

At a branch point between the sheet ejection path 25 and the branch 23, a guide member 26 is provided. The guide member 26 can switch between a state in which the recording sheet P is guided to the pair of sheet ejecting rollers 24 and a state in which the recording sheet P is guided to the pair of circulating rollers 29. The guide member 26 can switch between the state in which the recording sheet P is guided to the pair of circulating rollers 29 and the state in which the recording sheet P is guided to the pair of sheet ejecting rollers 24, for example, with use of a guide switch motor 47.

At an opposite side of the ejected-sheet tray 41 with respect to the branch 23, a fan 42 that moves air toward the pair of circulating rollers 29 and the pair of sheet ejecting rollers 24 is provided. The fan 42 moves air past the pair of circulating rollers 29 and the pair of sheet ejecting rollers 24 and the air flows above the ejected-sheet tray 41. The fan 42 is controlled by pulse-width modulation (PWM) and thereby an amount of air is modified.

In the case of both-side image formation mode (duplex printing mode) according to which a toner image is formed on one side (verso side) of the recording sheet P that has had a toner image formed on the other side (recto side), the recording sheet P is transported to the circulation path 27 after being held above the ejected-sheet tray 41 by the pair of circulating rollers 29. The recording sheet P that has passed through the circulation path 27 is transported to the resist rollers 28 so that, when the recording sheet P reaches the resist rollers 28, the recording sheet P is turned over.

When duplex printing is successively performed on a plurality of recording sheets, the pair of circulating rollers 29 are stopped so as to hold the rear end portion of the recording sheet P for a predetermined time period. When the recording sheet P is being held by the pair of circulating rollers 29, a substantially entire part thereof is positioned above the ejected-sheet tray 41.

Note that transportation of the recording sheet P in the case of successively forming a toner image on both sides of each of the plurality of recording sheets P is the same as a conventional art. In the present embodiment, when the first two recording sheets P are housed in the circulation path 27, a preceding one of the two recording sheets P is transported to the transfer nip N1 after an immediately subsequent recording sheet P transported from the paper feeding cassette 22 of the paper feeder B is transported to the transfer nip N1. After that, when a recording sheet is newly transported from the paper feeding cassette 22 of the paper feeder B, the new recording sheet and a preceding recording sheet P of two recording sheets housed in the circulation path 27 are alternately transported to the transfer nip N1.

Also, the printer of the present embodiment performs toner drying control for drying toner by moving air with the fan 42 as follows: (i) in the case of performing printing on one side of each of recording sheets P that are successively transported, a rear end portion of each of the recording sheets P is held by the pair of sheet ejecting rollers 24 and the pair of sheet ejecting rollers 29; and (ii) in the case of performing printing on both sides of each of recording sheets P, a rear end portion of each of the recording sheets P is held by the pair of sheet ejecting rollers 24 and the pair of circulating rollers 29.

Figure 3:
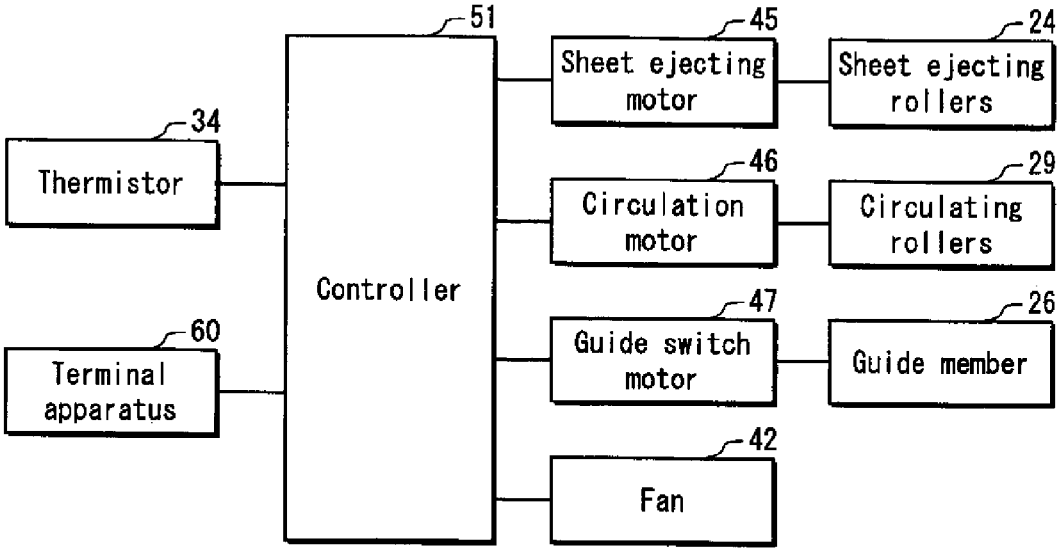
FIG. 3 is a block diagram showing a structure of a main portion of a control system that performs a toner drying control in the printer of FIG. 1.

FIG. 3 is a block diagram showing a structure of a main portion of a control system that performs toner drying control. The toner drying control is performed by the controller 51. The controller 51 includes a CPU, a ROM, a RAM, and an input/output interface (I/O) and the like.

Various types of information required for printing on each of recording sheets P are input from an external terminal apparatus 60 to the controller 51. The information input from the terminal apparatus 60 indicates image data for each of the recording sheets P (including information of full-color printing or monochrome printing), a type of the recording sheets P (thickness of a plain sheet or a heavy sheet, for example), a size of the recording sheets P, the number of the recording sheets P on which printing is to be performed, and the like.

Also, to the controller 51, output from the thermistor 34 provided on the fixing device 30 is given.

The controller 51 controls (i) the sheet ejecting motor 45 that rotates and stops the pair of sheet ejecting rollers 24, (ii) the circulation motor 46 that rotates the pair of circulating rollers 29 in the forward direction and in the reverse direction and stops the pair of circulating rollers 29, and (iii) the guide switch motor 47 that switches guide directions of a recording sheet P, the recording sheet P being selectively guided to the pair of sheet ejecting rollers 24 or to the pair of circulating rollers 29. Also, the controller 51 controls the fan 42 by PWM such that a predetermined amount of air is moved by the fan 42.

<Toner Drying Control in the Case of One-side Printing>

Figure 4:
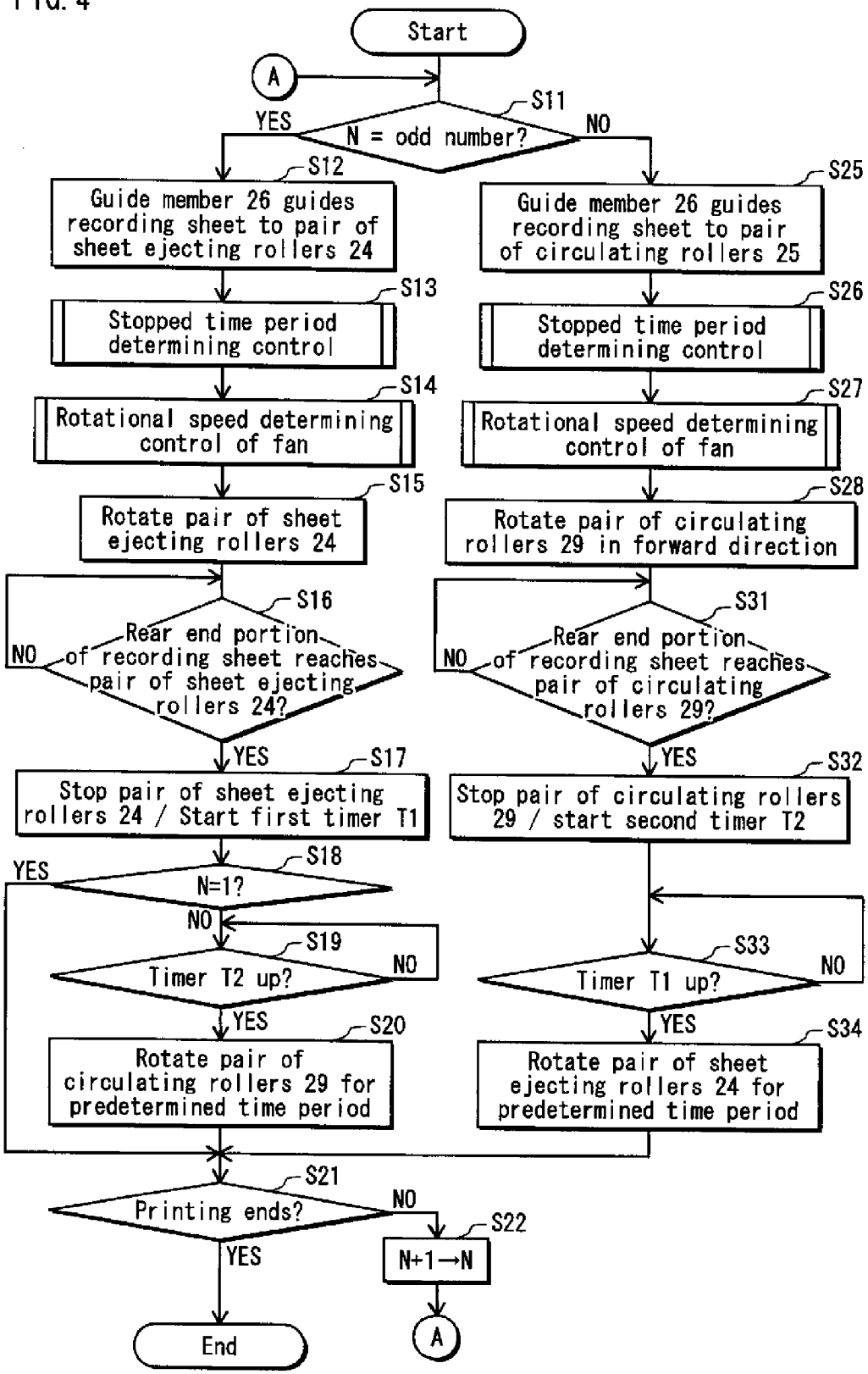
FIG. 4 is a flowchart showing a procedure of the toner drying control, which is performed by a controller when printing is successively performed on one side of each of a plurality of recording sheets.

FIG. 4 is a flowchart showing a procedure of the toner drying control, which is performed by the controller 51 when printing is successively performed on one side of each of a plurality of recording sheets P. FIGS. 5A-5G are schematic views each showing states of the recording sheets that are transported in the toner drying control.

In such toner drying control, when two recording sheets P are successively transported from the paper feeding cassette 22 of the paper feeder B and printing on each of the recording sheets has finished, the pair of sheet ejecting rollers 24 that are positioned lower than the pair of circulating rollers 29 hold an odd-numbered recording sheet P, and the pair of circulating rollers 29 that is positioned above the pair of sheet ejecting rollers 24 hold an even-numbered recording sheet P that is transported immediately after the odd-numbered recording sheet P.

When printing is instructed, the controller 51 receives a count value N of a counter that counts the number of recording sheets to be printed (the number of printing) at the image processing unit A so as to judge whether the count value N is an odd number (see step S11 in FIG. 4, and the following steps S12-22, S25-28, and S31-34 are also shown in FIG. 4). Note that the counter counts the number of printing on the recording sheets P. Accordingly, in the case of performing printing on one side of each of the recording sheets P that are successively transported, the number of printing counted by the counter is equal to the number of the recording sheets P ejected onto the ejected-sheet tray 41.

At first when printing is instructed, the count value N is 1. This represents the first printing. Therefore, in step S11, "YES" is selected. The controller 51 then drives the guide switch motor 47 to cause the guide member 26 to guide the recording sheet P to the pair of sheet ejecting rollers 24 (step S12). When the guide member 26 has been already set to guide the recording sheet P to the pair of sheet ejecting rollers 24, it is unnecessary to drive the guide switch motor 47.

Next, control for judging whether a stopped time period needs to be longer than the predetermined time period (stopped time period determining control) is performed (step S13). The stopped time period represents a time period during which the pair of sheet ejecting rollers 24 or the pair of circulating rollers 29 hold a recording sheet P on which printing has been performed.

Figure 6:
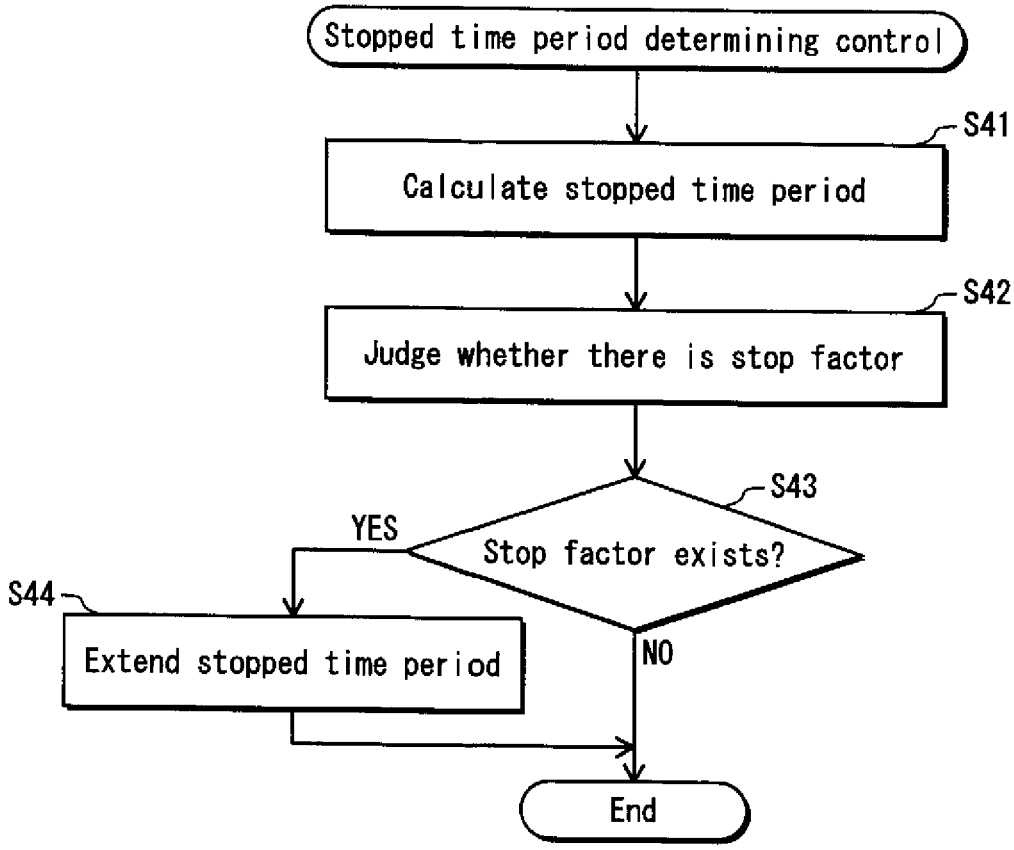
FIG. 6 is a flowchart showing a procedure of a sub routine of a stopped time period determining control that is performed in the toner drying control.

FIG. 6 is a flowchart showing a procedure of the stopped time period determining control. When receiving instruction to perform the stopped time period determining control, the controller 51 firstly calculates, based on which of the pair of sheet ejecting rollers 24 and the pair of circulating rollers 29 hold the recording sheet P, a time period (stopped time period) during which the pair of sheet ejecting rollers 24 or the pair of circulating rollers 29 hold the recording sheet P (see step S41 in FIG. 6, and the following steps S42-44 are also shown in FIG. 6). The stopped time period differs between the case where the pair of sheet ejecting rollers 24 hold an odd-numbered recording sheet P and the case where the pair of circulating rollers 29 hold an even-numbered recording sheet P.

The pair of sheet ejecting rollers 24 can hold an odd-numbered recording sheet P at least until a next odd-numbered recording sheet P reaches the pair of sheet ejecting rollers 24.

Figures 7, 8:
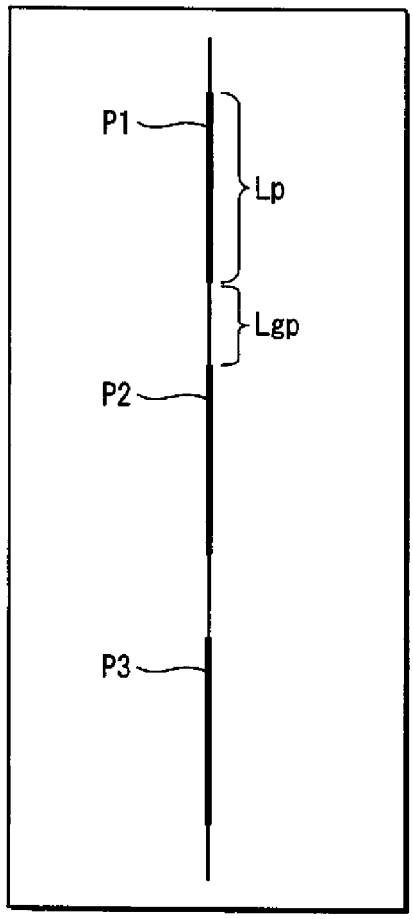
FIG. 7 is a schematic view explaining a length of a recording sheet and an interval between recording sheets that are used for calculating a stopped time period in the stopped time period determining control performed in the toner drying control.
FIG. 8 is a table showing examples of methods for calculating the stopped time period and calculation results in the stopped time period determining control.

Therefore, a stopped time period To during which the pair of sheet ejecting rollers 24 can hold an odd-numbered recording sheet P can be calculated by the following function (1), based on a length Lp obtained from a size of the recording sheet P in a transport direction in which the recording sheet P is transported, an interval Lgp between recording sheets P successively transported, and a transport speed (system speed) Sp of the recording sheets P, as shown in FIG. 7.

$$To=\{Lp+(2\times Lgp)\}/Sp+\alpha \quad (1)$$

Note that $\alpha$ is a correction time period that is set in view of the case where the interval Lgp between recording sheets P becomes large when recording sheets P in the paper feeding cassette 22 run out and a user supplies recording sheets P. Generally, $\alpha$ is set to 0.5 seconds or less.

The pair of sheet ejecting rollers 24 can hold an odd-numbered recording sheet P at least until an immediately subsequent odd-numbered recording sheet P reaches the pair of sheet ejecting rollers 24.

Therefore, a time period (stopped time period) Te during which the pair of circulating rollers 29 can hold and stop an even-numbered recording sheet P can be calculated by the following function (2), based on a length Lp of the recording sheet P in the transport direction, an interval Lgp between recording sheets P, a path length L1 of a length from the guide member 26 to the pair of sheet ejecting rollers 24, and a path length L2 of a length from the guide member 26 to the pair of circulating rollers 29, as shown in FIG. 7.

$$Te=(L1-L2+Lp+Lgp)\}/Sp+\alpha \quad (2)$$

The controller 51 receives the length Lp in the transport direction of the recording sheet P and the interval Lgp between recording sheets P successively transported from a table stored in a ROM, for example, based on the size of the recording sheet P that is obtained by image data from the terminal apparatus 60. Also, the controller 51 receives the system speed Sp that is determined based on whether the image data from the terminal apparatus 60 is full-color data or monochrome data. Then the controller calculates the stopped time period To for an odd-numbered recording sheet P using the function (1), and the stopped time period Te for an even-numbered recording sheet P using the function (2).

When (i) printing is successively performed on one side of each of recording sheets P of an A4 size, (ii) the transport direction is a longitudinal direction of the recording sheets P, (iii) the path length L1 of a length from the guide member 26 to the pair of sheet ejecting rollers 24 is 100 mm, and (iv) the path length L2 of a length from the guide member 26 to the pair of circulating rollers 29 is 100 mm, the stopped time period To of an odd-numbered recording sheet is 2.1 seconds and the stopped time period Te of an even-numbered recording sheets is 1.8 seconds (note that $\alpha$=0). In this case, the length Lp of the recording sheet P of the A4 size in the transport direction is 297 mm, an interval between recording sheets P is 60 mm, and a transport speed (printing speed) is 200 mm/s.

A table of FIG. 8 shows (i) the functions (1) and (2) for obtaining the stopped time period To of an odd-numbered recording sheet and the stopped time period Te of an even-numbered recording sheet, and (ii) examples of the stopped time period To and the stopped time period Te in the case of the recording sheet P of the A4 size.

When the stopped time period To or Te is calculated as described above in step S41 of FIG. 6, processing proceeds to step S42. Then it is judged whether there is a need (stop factor) to stop transport of the recording sheet P or not. It is thought that example's of the stop factor include a case where recording sheets Pin the paper feeding cassette 22 run out and a case where printing is switched from a monochrome mode to a full-color mode.

When the stop factor exists ("YES" in step S43), the stopped time period (To or Te) calculated in step S41 extends for a predetermined extra time period (step S44). The extra time period in this case is determined based on the calculated stopped time period, and for example, when the calculated stopped time period is 2 seconds, the extra time period is determined to be 3 seconds.

Thus, (i) the stopped time period To of an odd-numbered recording sheet and the stopped time period Te of an even-numbered recording sheet, which have been calculated in step S41, or (ii) in the case where the predetermined extra time period has been added to each of the stopped time periods To and Te in step S44, the stopped time periods To and Te to which the extra time periods have been added are set to a first reserved stopped time period TK1 of an odd-numbered recording sheet and a second reserved stopped time period TK2 of an even-numbered recording sheet, respectively.

When the first reserved stopped time period TK1 of an odd-numbered recording sheet and the second reserved stopped time period TK2 of an even-numbered recording sheet are obtained by control for extending the stopped time period, processing proceeds to step S14 in a main routine in FIG. 4.

Note that with regard to the first recording sheet P (hereinafter, the first recording sheet is P1, the second recording sheet is P2, . . . , the n-th recording sheet is Pn), the reserved stopped time period TK1 is obtained by calculating the stopped time period To of an odd-numbered recording sheet with use of the function (1) in step S41 of a sub routine in the stopped time period determining control in step S13 in FIG. 4.

In step S14, a rotational speed of the fan 42 required to dry a toner image on the first recording sheet P1 is obtained, and a control to set a rotational speed of the fan 42 to the obtained rotational speed (rotational speed determining control of the fan 42) is performed (step S14). In the rotational speed determining control of the fan 42, the rotational speed of the fan 42 for moving a most appropriate amount of air toward the first recording sheet P1 is calculated based on information of the first recording sheet P1, which is obtained from the external terminal apparatus 60. Details of the rotational speed determining control will be described later.

When the rotational speed determining control in step S14 ends, the fan 42 rotates at the predetermined rotational speed so as to move the predetermined amount of air.

After that, the pair of sheet ejecting rollers 24 are rotated by the sheet ejecting motor 45 (step S15), and until the rear end portion of the recording sheet P reaches the pair of sheet ejecting rollers 24, the fan 24 remains stopped (step S16).

Figure 5A:
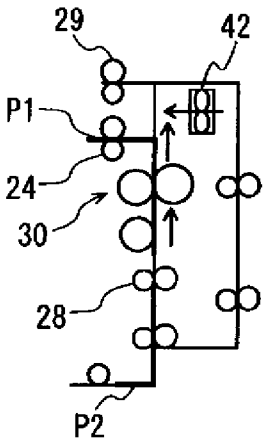
FIGS. 5A-5G are schematic views each showing states of the recording sheets that are transported in the toner drying control.

While the fan 24 remains stopped, as shown in FIG. 5A, the first recording sheet P1 passes through the fixing device 30 and is transported to the pair of sheet ejecting rollers 24. While the recording sheet P1 is transported to the pair of sheet ejecting rollers 24, the second recording sheet P2 is transported to the pair of resist rollers 28.

While passing through the fixing device 30 and being transported through the sheet ejection path 25, the first recording sheet P1 is cooled by air blown thereonto by the fan 42.

When a predetermined time period during which the rear end portion of the first recording sheet P1 reaches the pair of sheet ejecting rollers 24 elapses ("YES" in step S16), the sheet ejecting motor 45 stops so as to stop rotation of the pair of sheet ejecting rollers 24 so that the rear end portion of the recording sheet P1 is held by the pair of sheet ejecting rollers 24. At the same time, a first timer T1 starts clocking a time (step S17). The first timer T1 continues clocking a time while the pair of sheet ejecting rollers 24 remain stopped for the first reserved stopped time period TK1.

Figure 5B:
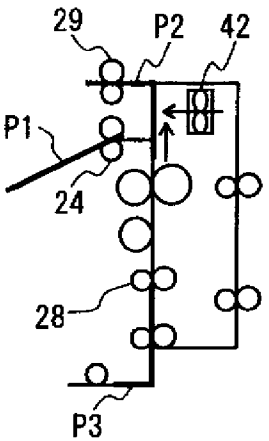

When rotation of the pair of sheet ejecting rollers 24 stops, the first recording sheet P1 in a stopped state is positioned above the ejected-sheet tray 41 while the rear end portion of the recording sheet P1 is held by the pair of sheet ejecting rollers 24 (see FIG. 5B). In this case, since the fan 42 is being driven at the predetermined rotational speed, air moved by the fan 42 is blown onto the first recording sheet P1 held by the pair of sheet ejecting rollers 24. This efficiently cools the recording sheet P1 and dries the toner image printed on the one side of the recording sheet P1.

In addition, a time period during which the pair of sheet ejecting rollers 24 hold the recording sheet P1 is set to the reserved stopped time period (TK1) that has been obtained by the stopped time period determining control in step S13, and a stopped time period is clocked by the first timer T1. Then while the first timer T1 is clocking the stopped time period TK1, the fan 42 continues to cool the recording sheet P1 by moving air.

When the pair of sheet ejecting rollers 24 hold the rear end portion of the first recording sheet P1, whether the count value N of printing is 1 or not is judged (step S18). If the count value N of printing is 1, it is judged that printing is performed on the first recording sheet P1, and processing proceeds to step S21. Then whether printing has completely ended or not is judged.

The case where the count value N of printing is not 1 but equal to or more than 2, that is, printing is performed not on the first recording sheet P1 ("NO" in step S18) will be described later.

In step S21, printing has not been performed on all recording sheets P ("NO" in step S21). Therefore, the count value N of the counter that counts the number of recording sheets P that have been printed is incremented by 1 (step S22) and the processing returns to step S11.

If printing has been performed on all recording sheets P in step S21 ("YES" in step S21), printing ends.

When the processing returns to step S11, whether the count value N indicating the number of recording sheets to be printed is an odd number is judged. In this case, since the count value. N indicating the number of recording sheets to be printed is 2, which is an even number ("NO" in step S11), the processing proceeds to step S25. Then the guide member 26 guides a recording sheet P to the pair of circulating rollers 29. Since the guide member 26 has been set to guide the recording sheet P to the pair of sheet ejecting rollers 24, the guide switch motor 46 is rotated in the forward direction.

Next, a stopped time period determining control that is the same as the stopped time period determining control described in step S13 is performed (step S26). In the stopped time period determining control performed here, a stopped time period of the second recording sheet P2 is calculated with use of the function (2) for calculating the stopped time period Te of an even-numbered recording sheet.

According to the stopped time period determining control in step S26, a reserved stopped time period TK2 for the second recording sheet P2 is obtained. Then a fan rotational speed determining control is performed (step S27), according to which a rotational speed of the fan 42 required to dry a toner image on the second recording sheet P2 is obtained, and the rotational speed of the fan 42 is set to the obtained rotational speed. The fan rotational speed determining control in this case is the same as the fan rotational speed determining control in step S14, and will be described later.

After the rotational speed determining control of the fan 42 is performed, a rotational speed of the fan 42 is switched to the rotational speed obtained for the second recording sheet P2. Accordingly, after passing through the fixing device 30 and until the rotational speed of the fan 42 is switched, the first recording sheet P1 held by the pair of sheet ejecting rollers 24 is being cooled by air whose amount is most appropriate for the first recording sheet P1, which is moved by the fan 42.

After that, at a timing immediately before the second recording sheet P2 reaches the pair of circulating rollers 29, the circulation motor 46 rotates the pair of circulating rollers 29 in the forward direction (step S28). Then until a rear end portion of the second recording sheet P2 reaches the pair of circulating rollers 29, the pair of circulating rollers 29 continue rotating in the forward direction (step S31).

While the pair of circulating rollers 29 continue rotating, as shown in FIG. 5B, the second recording sheet P2 passing through the fixing device 30 is guided by the guide member 26 to the branch 23, and then is transported to the pair of circulating rollers 29. In addition, while the second recording sheet P2 is transported to the pair of circulating rollers 29, the third recording sheet P3 is transported to the pair of resist rollers 28.

When the rear end portion of the second recording sheet P2 reaches the pair of circulating rollers 29 ("YES" in step S31), rotation of the circulation motor 46 is stopped so as to stop rotation of the pair of circulating rollers 29 so that the pair of circulating rollers 29 hold the rear end portion of the second recording sheet P2. At the same time, a second timer T2 starts clocking a time (step S32). The second timer T2 continues clocking a time while the pair of circulating rollers 29 remain stopped for the second reserved stopped time period TK2.

Figure 5C:
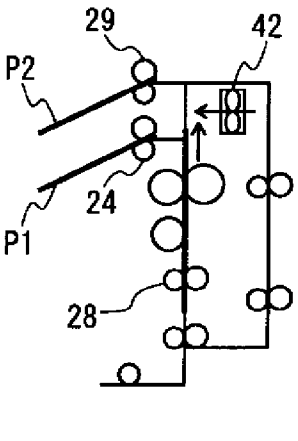

When rotation of the pair of circulating rollers 29 stops, as shown in FIG. 5C, the rear end portion of the second recording sheet P2 is held by the pair of circulating rollers 29. Accordingly, the second recording sheet P2 is positioned above the first recording sheet P1 whose rear end portion is held by the pair of sheet ejecting rollers 24.

In this case, the fan 42 is driven at a rotational speed that is appropriate to cool the second recording sheet P2, and air from the fan 42 is blown onto the second recording sheet P2. This efficiently cools the second recording sheet P2, and accordingly the toner image printed on the one side of the recording sheet P2 dries. In addition, since the first recording sheet P1 is also held by the pair of sheet ejecting rollers 24 under the second recording sheet P2, the first recording sheet P1 is also cooled together with the second recording sheet P2 by air moved by the fan 42.

After that, whether the first timer T1 that started clocking the stopped time period of the pair of sheet ejecting rollers 24 has timed the first reserved stopped time period TK1 (whether the first timer T1 is in an up state) is judged (step S33). If the first timer T1 has not timed the first reserved stopped time period TK1 ("NO" in the step S33), the pair of sheet ejecting rollers 24 wait until the first timer T1 times the first reserved stopped time period TK1. Then once the first timer T1 times the first reserved stopped time period TK1 ("YES" in step S33), the sheet ejecting motor 45 is driven and accordingly the pair of sheet ejecting rollers 24 are rotated for a predetermined time period (step S34). As a result, the first recording sheet P1 that has been held by the pair of sheet ejecting rollers 24 is ejected onto the ejected-sheet tray 41.

Normally, the rear end portion of the second recording sheet P2 is held by the pair of circulating rollers 29 before the reserved stopped time period TK1 of the first recording sheet P1 elapses. Accordingly, after the rear end portion of the second recording sheet P2 is held by the pair of circulating rollers 29, the first recording sheet P1 is ejected onto the ejected-sheet tray 41. In addition, in the case where the reserved stopped time period TK1 of the first recording sheet P1 elapses after the rear end portion of the second recording sheet P2 is held by the pair of circulating rollers 29, the first recording sheet P1 is ejected onto the ejected-sheet tray 41 when the reserved stopped time period TK1 elapses.

After the first recording sheet P1 is ejected onto the ejected-sheet tray 41, the processing proceeds to step S21, and then as described above, whether printing has completely ended or not is judged. If printing has been performed on all recording sheets P ("YES" in step S21), printing ends. If printing has not been performed on all recording sheets P ("NO" in step S21), the count value N of the counter that counts the number of recording sheets P that have been printed is incremented by 1 (step S22) and the processing returns to step S11.

In step S11, whether the count value N indicating the number of recording sheets to be printed is an odd number or not is judged. In this case, since the count value N indicating the number of recording sheets to be printed is 3, which is an odd number, the processing proceeds to step S12. Then the guide member 26 guides the recording sheet P to the pair of sheet ejecting rollers 24. Hereinafter, as described above, controls from step S13 to step S17 are performed.

Figure 5D:
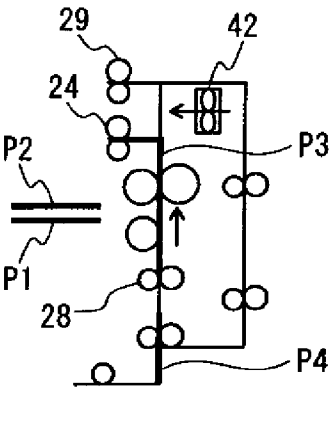

After that, in step S18, since the count value N is 3 and printing is not performed on the first recording sheet P1 ("NO" in step S18), whether the second timer T2 that has started clocking has timed the second reserved stopped time period TK2 (whether the second timer T2 is in an up state) is judged (step S19). If the second timer T2 has already timed the second reserved stopped time period TK2 or the second timer T2 times the second reserved stopped time period TK2 after the judgment ("YES" in step S19), the pair of circulating rollers 29 are rotated in the forward direction for a predetermined time period (step S20), and as shown in FIG. 5D, the second recording sheet P2 held by the pair of circulating rollers 29 is ejected onto the ejected-sheet tray 41.

Normally, the rear end portion of the second recording sheet P2 is held by the pair of circulating rollers 29 before the reserved stopped time period TK1 of the first recording sheet P1 elapses. Accordingly, after the rear end portion of the second recording sheet P2 is held by the pair of circulating rollers 29, the first recording sheet P1 is ejected onto the ejected-sheet tray 41. As a result, the second recording sheet P2 might not be ejected onto the ejected-sheet tray 41 before the first recording sheet P1.

In addition, in the case where the reserved stopped time period TK1 of the first recording sheet P1 elapses after the rear end portion of the second recording sheet P2 is held by the pair of circulating rollers 29, the first recording sheet P1 is ejected onto the ejected-sheet tray 41 when the reserved stopped time period TK1 elapses.

Figure 5E:
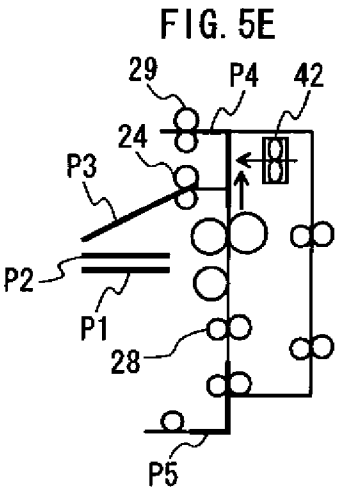
Figure 5F:
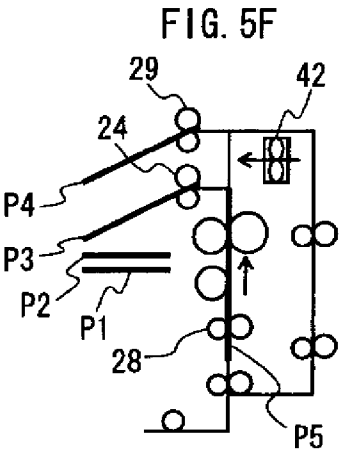
Figure 5G:
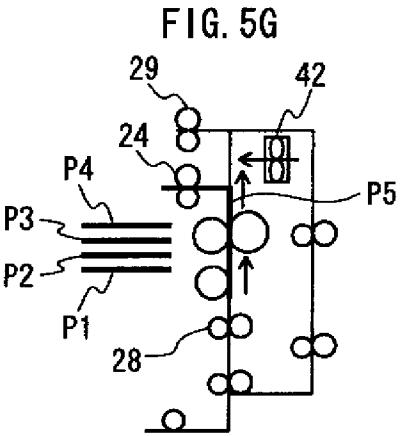

Hereinafter, the same control is repeated. As a result, as shown in FIG. 5E, the rear end portion of the third recording sheet P3 is held by the pair of sheet ejecting rollers 24. While the recording sheet P3 is receiving air moved by the fan 42, as shown in FIG. 5F, a rear end portion of the fourth recording sheet P4 is transported to the pair of circulating rollers 29 and held by the pair of circulating rollers 29. Then, after the third recording sheet P3 is ejected onto the ejected-sheet tray 41, the fourth recording sheet P4 is ejected onto the ejected-sheet tray 41 and placed on the ejected-sheet tray 41 as shown in FIG. 5G.

Figure 9:
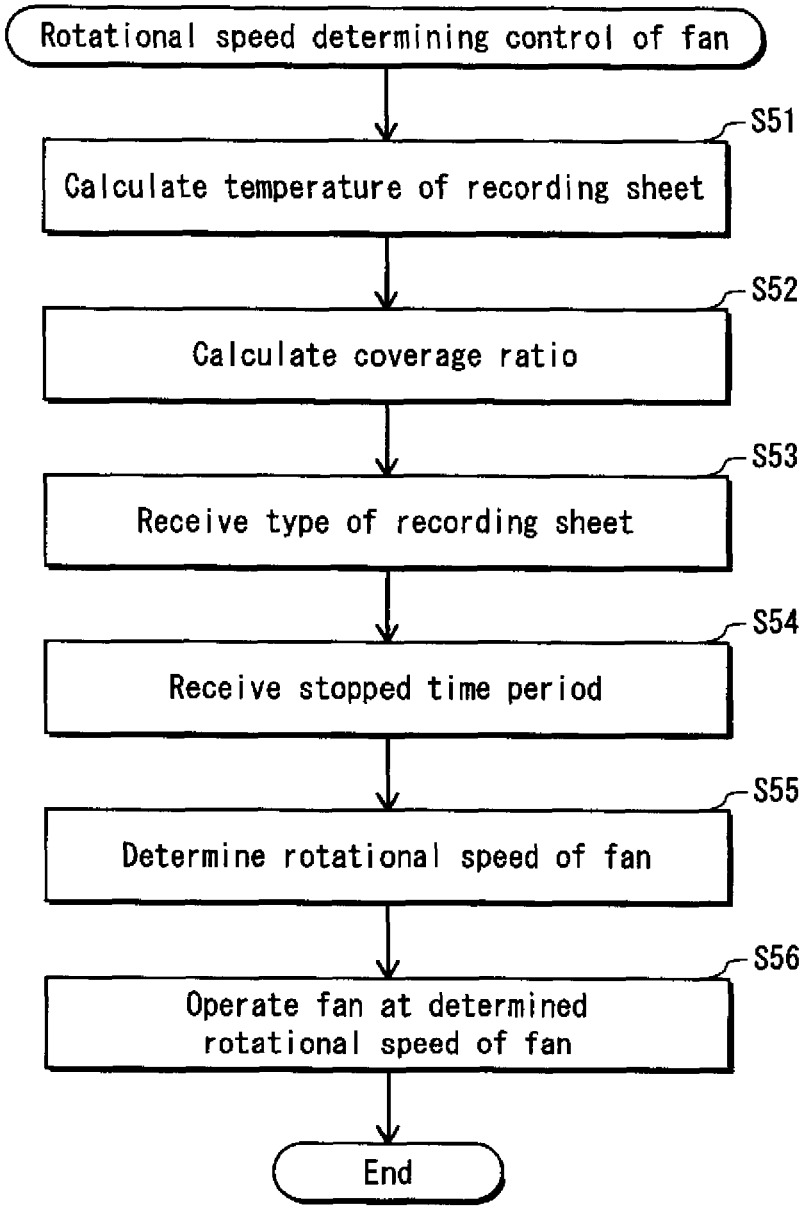
FIG. 9 is a flowchart showing a procedure of a sub routine of a fan rotational speed determining control that is performed in the toner drying control.

Next, the following describes a fan rotational speed determining control performed in each of step S14 and step S27. FIG. 9 is a flowchart showing a procedure of the fan rotational speed determining control. When the fan rotational speed determining control is instructed, the controller 51 calculates a temperature of a recording sheet P that has just passed through the fixing device 30, based on the number of recording sheets P that have been printed (see step S51 in FIG. 9, and the following steps S52-56 are also shown in FIG. 9). The temperature of the recording sheet P in this case varies according to the fixing temperature, coverage ratio (CW ratio), and a type of the recording sheet (plain or heavy).

Figure 10:
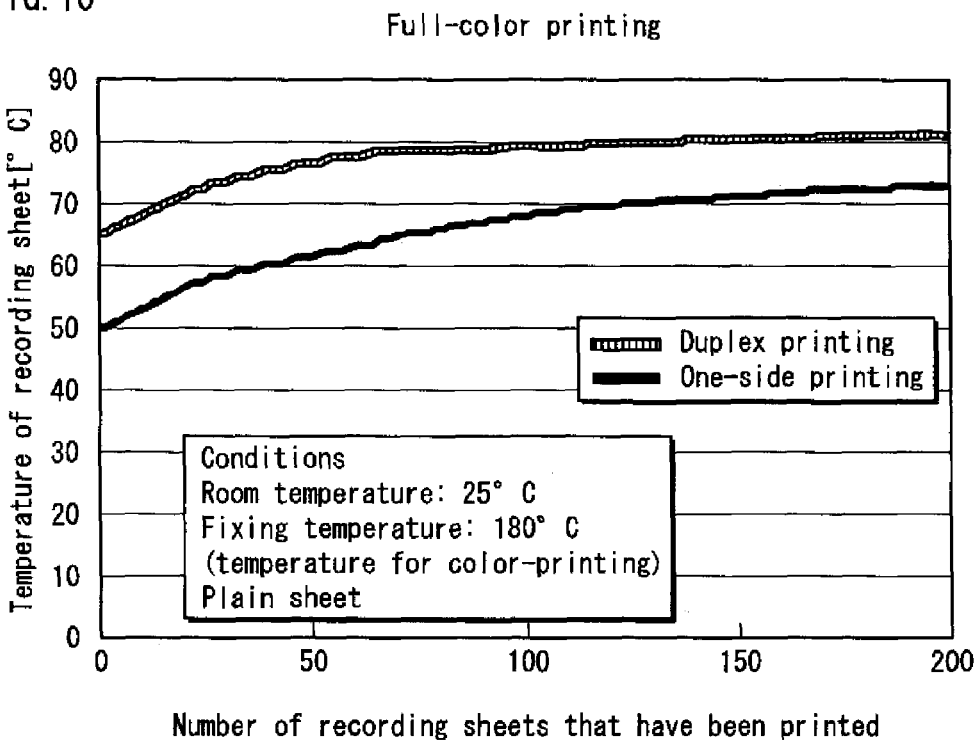
FIG. 10 is a graph showing a relationship between the number of printed recording sheets and temperatures of recording sheets passing through the fixing device in the case of forming a full-color image on a plain recording sheet.
Figure 11:
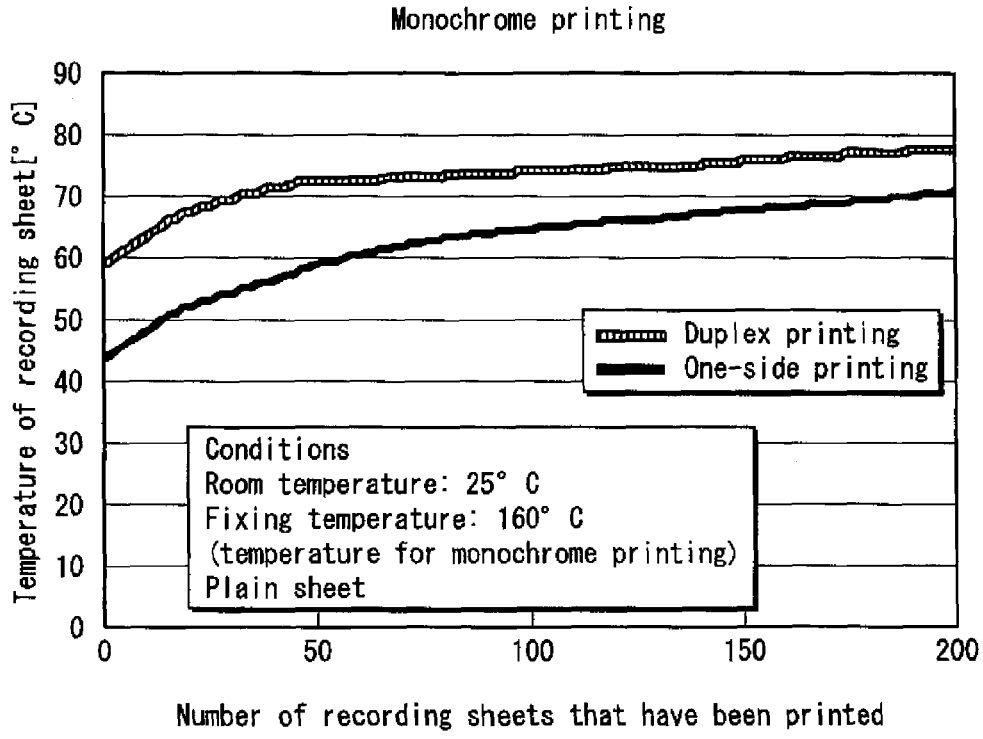
FIG. 11 is a graph showing a relationship between the number of printed recording sheets and temperatures of recording sheets passing through the fixing device in the case of forming a monochrome image on a plain recording sheet.
Figure 12:
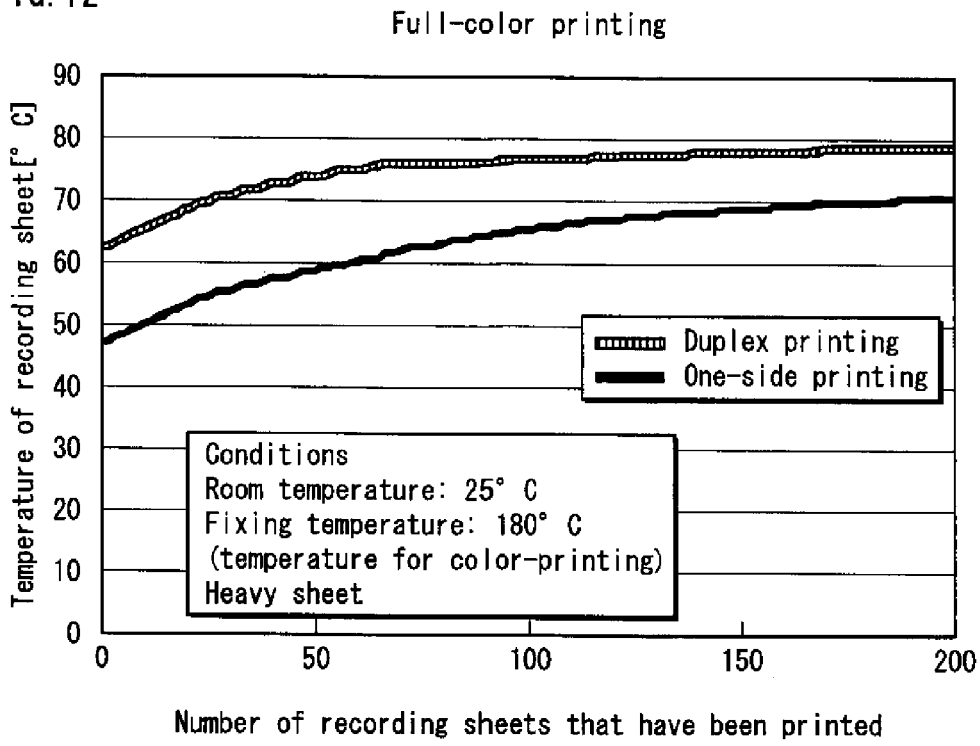
FIG. 12 is a graph showing a relationship between the number of printed recording sheets and temperatures of recording sheets passing through the fixing device in the case of forming a color image on a heavy recording sheet.
Figure 13:
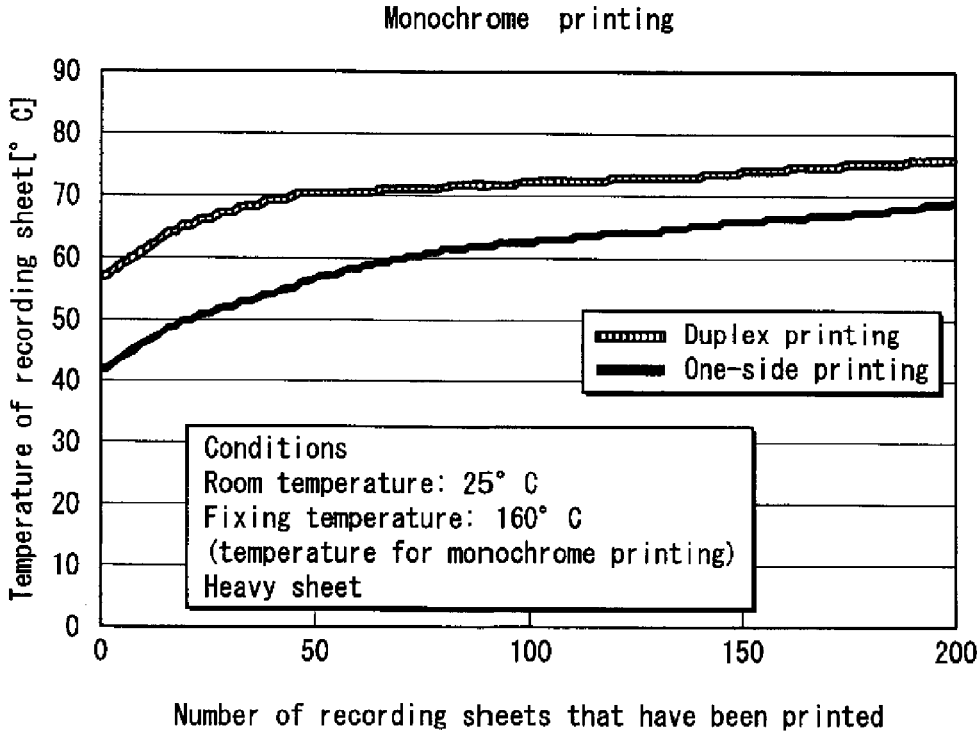
FIG. 13 is a graph showing a relationship between the number of printed recording sheets and temperatures of recording sheets passing through the fixing device in the case of forming a monochrome image on a heavy recording sheet.

FIGS. 10-13 each show a relationship between a temperature of a recording sheet P that has just passed through the fixing device 30 and the number of recording sheets on which printing is performed. FIG. 10 shows a case where a full-color image is formed on a plain recording sheet P, and FIG. 11 shows a case where a monochrome image is formed on a plain recording sheet P. FIG. 12 shows a case where a full-color image is formed on a heavy recording sheet P, and FIG. 13 shows a case where a monochrome image is formed on a heavy recording sheet P.

In each of FIGS. 10-13, when an ambient temperature of the printer is 25° C., the fixing temperatures in printing a full-color image and a monochrome image are controlled to be 180° C. and 160° C., respectively. FIGS. 10-13 each show a temperature of the recording sheet that has just passed through the fixing device 30 of the both cases of one-side printing and duplex printing.

In each case, as the number of recording sheets P that have been printed increases, the temperature of the recording sheets P rises. On the other hand, when the number of recording sheets P that have been printed is small, a rate of temperature rise of the recording sheets P is large, and as the number of recording sheets P that have been printed increases, the rate of temperature rise of the recording sheets P becomes small.

For this reason, in the case where printing is successively performed on each of a plurality of recording sheets, a temperature of a recording sheet P after fixation is estimated at each printing, based on the graphs of FIGS. 10-13 and by receiving the following information from image data input from the external terminal apparatus 60: full-color printing or monochrome printing, and whether the recording sheet P is a plain sheet or a heavy sheet. Note that data relating to FIGS. 10-13 is beforehand stored in the ROM of the controller 51.

The present embodiment describes a case of one-side printing, and accordingly a temperature of a recording sheet P after fixation is estimated based on the data of one-side printing in each of FIGS. 10-13. In a case of duplex printing that will be described later, a temperature of a recording sheet P after fixation is estimated based on the data of duplex printing in each of FIGS. 10-13.

After a temperature of a recording sheet P after fixation at each printing is estimated in step S51, a coverage ratio (CW ratio) indicating a ratio of a toner amount of a printed image is calculated based on the image data corresponding to the performed printing (step S52). When printing a full-color image, a coverage ratio of each of colors Y, M, C, and K is calculated, and all of the calculated coverage ratios of colors Y, M, C, and K are added.

Next, information whether the recording sheet P is a plain sheet or a heavy sheet is received from the data input from the external terminal apparatus 60 (step S53). In addition, the reserved stopped time periods TK1 or TK2 obtained in the stopped time judgment control (step S13 or step S26 in FIG. 4) performed at each printing is also received (step S54).

After that, based on a table indicating a rotational speed of the fan, which is shown in FIG. 14, a rotational speed of the fan is determined according to the temperature of the recording sheet P after fixation, the coverage ratio (CW ratio), the type of recording sheet P, and the reserved stopped time period TK1 or TK2 (step S55). Note that the table indicating the rotational speed of the fan, which is shown in FIG. 14 is beforehand stored in the ROM of the controller 51.

In the table indicating the rotational speed of the fan, which is shown in FIG. 14, rows are classified by whether a recording sheet P is a plain sheet or a heavy sheet in each of the cases where the reserved stopped time period is 1.5 to 2 seconds, 2 to 2.5 seconds, 2.5 to 4.5 seconds, and 4.5 seconds and more. Furthermore, the case where a recording sheet P is a plain sheet is divided by the cases where the coverage ratio (CW ratio) is less than or equal to 20% and more than 20%. The table indicates the most appropriate rotational speed of the fan 42 at each predetermined range (each of 55 to 60° C., 60° C. to 65° C., 65 to 70° C., 70 to 75° C., and 75 to 80° C.) of a temperature of a recording sheet P after fixation. Note that the rotational speed of the fan 42 is indicated by a ratio of air, where the maximum amount of air controlled by the PWM is indicated as 100%.

In the table indicating the rotational speed of the fan, which is shown in FIG. 14, as the reserved stopped time period TK1 or TK2 increases, the rotational speed of the fan 42 becomes lower and the fan 42 moves a small amount of air. However, in any range of the reserved stopped time period, as the temperature of the recording sheet P after fixation increases and the coverage ratio (CW ratio) increases, the rotational speed of the fan 42 is made larger and accordingly an amount of air moves by the fan 42 is made larger. In any range, in the case where the recording sheet is a heavy sheet, the rotational speed of the fan 42 is made larger and the fan 42 moves a large amount of air, compared with the case of a plain sheet.

In step S55, after the rotational speed of the fan 42 is determined, the controller 51 causes the fan 42 to operate at the determined rotational speed (step S56).

Accordingly, in step S14 of FIG. 4, since the above control to determine the rotational speed of the fan is performed, the rotational speed of the fan 42 is controlled and the fan 42 is driven so that an amount of moved air is most appropriate for printing that is to be performed immediately after the determination of the rotational speed of the fan. As a result, an odd-numbered recording sheet P that passes through the fixing device 30 after that and is held by the pair of sheet ejecting rollers 24 is cooled by the air moved by the fan 42 that is controlled so as to move the most appropriate amount of air to cool the odd-numbered recording sheet P.

Similarly, in step S27 of FIG. 4, since the above control to determine the rotational speed of the fan 42 is performed, the rotational speed of the fan 42 is controlled and the fan 42 is driven so that the amount of air is most appropriate for printing that is to be performed immediately after the determination of the rotational speed of the fan. Accordingly, an even-numbered recording sheet P that passes through the fixing device 30 after that and is held by the pair of circulating rollers 29 is cooled by the air moved by the fan 42 that is controlled so as to move the most appropriate amount of air.

As described above, in the case where printing is performed on one-side of each of recording sheets P that are successively transported, while each of the pair of sheet ejecting rollers 24 and the pair of circulating rollers 29 are holding a recording sheet P, each recording sheet P is cooled at the same time. Accordingly, a toner image on each recording sheet P can be efficiently dried. Therefore, fixing tacking is reliably prevented from occurring when each recording sheet P is ejected onto the ejected-sheet tray 41.

Note that the image forming apparatus of the present embodiment that successively performs printing on one-side of each of recording sheets that are successively transported is not limited to an image forming apparatus provided with the circulation path 27, and the present embodiment can be also applied to an image forming apparatus not provided with the circulation path 27. In this case, together with the branch 23 and the guide member 26, a pair of second sheet ejecting rollers for ejecting recording sheets P onto the ejected-sheet tray 41 may be provided at an end of the branch 23 that is positioned above the pair of sheet ejecting rollers 24, instead of the pair of circulating rollers 29.

<Toner Drying Control in the Case of Duplex Printing>

Figure 15:
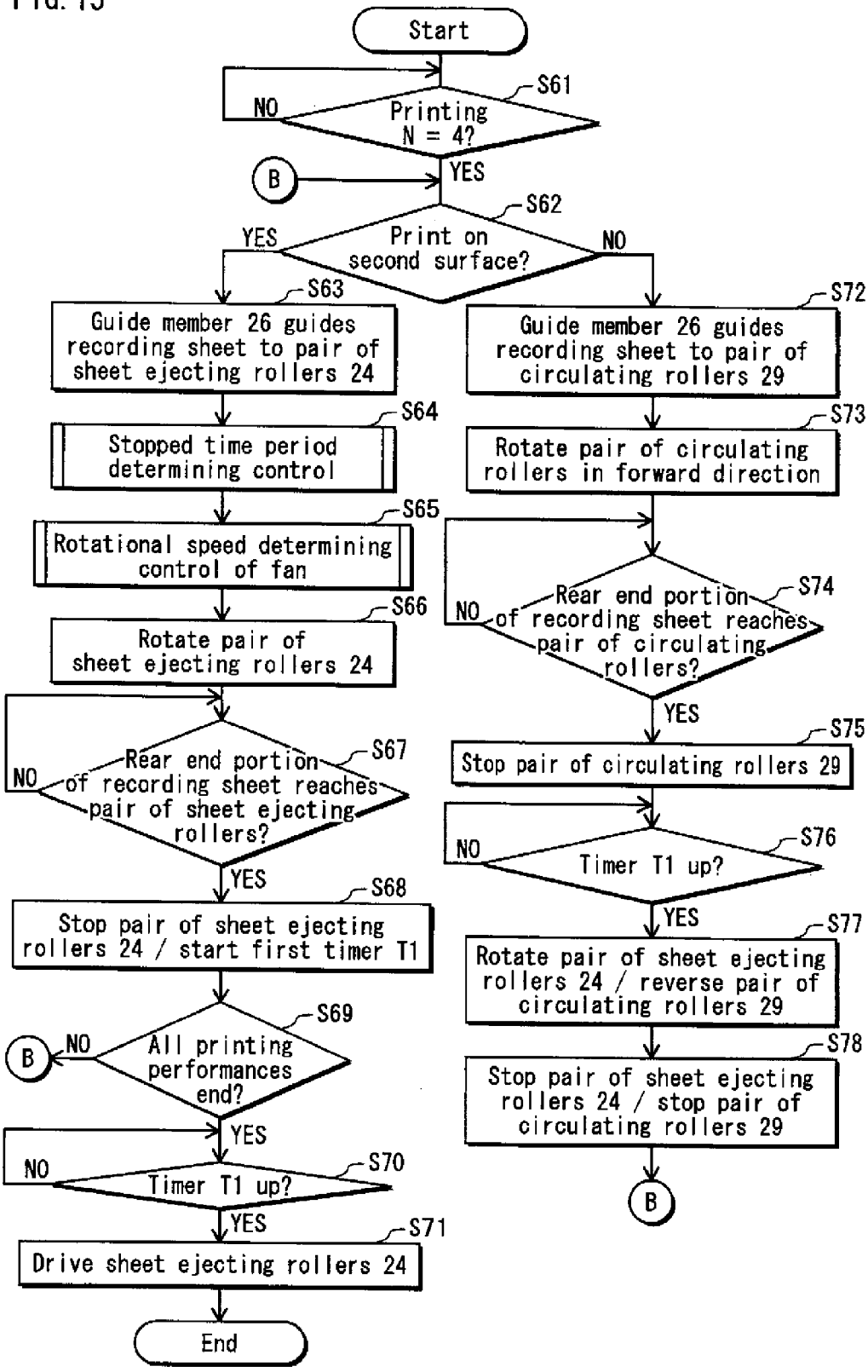
FIG. 15 is a flowchart showing a procedure of the toner drying control in the case where an image is successively formed on both sides of each of a plurality of recording sheets.

Next, the following describes the toner drying control in the case of successively printing images on both sides of each of a plurality of recording sheets P. FIG. 15 is a flowchart showing a procedure of the toner drying control in such a case, and FIGS. 16A-16K are schematic views each showing states of the recording sheets P that are successively transported in the toner drying control.

According to the printer of the present embodiment, in the case where printing is successively performed on both sides of each of a plurality of recording sheets P, printing is successively performed on a verso side (hereinafter, the side on which printing is performed first is referred to as "first print surface") of each of three recording sheets P1, P2, and P3 that are transported from the paper feeding cassette 22, and the three recording sheets are transported to the circulation path 27 in order. Next, after printing is performed on a recto side (hereinafter, referred to as "second print surface") of the recording sheet P1, printing is performed on the first print surface of the fourth recording sheet P4 transported from the paper feeding cassette 22. Each of the recording sheets P1 to P3 is not held by the pair of circulating rollers 29 to dry toner.

After printing is performed on the first print surface of the fourth recording sheet P4, printing is alternately performed on the second print surface of a recording sheet that is transported from the circulation path 27 (the second recording sheet P2, the third recording sheet P3, and so on) and on the first print surface of a recording sheet that is transported from the paper feeding cassette 22 (the fifth recording sheet P5, the sixth recording sheet P6, and so on).

The recording sheets P whose both sides have already finished being printed are ejected onto the ejected-sheet tray 41 with the second print surface (recto side) facing down the ejected-sheet tray 41 in an order of transport from the paper feeding cassette 22, and the recording sheets whose first print surface (verso side) has finished being printed are transported to the circulation path 27.

According to the printer of the present embodiment, in the case where printing is successively performed on both sides of each of recording sheets P whose number is equal to or more than three, a circular path formed by the circulation path 27 and a transport path (from the guide member 26 through the circulation path 27 to the guide member 26) for transferring and fixing toner images houses three recording sheets P. Therefore, hereinafter, such a circulation path is referred to as "a circulation path housing three recording sheets".

The following describes the toner drying control performed by the controller 51 in such duplex printing, based on FIG. 15 and FIGS. 16A to 16K.

The controller 51 does not perform the toner drying control until the count value N of the counter that counts the number of recording sheets to be printed (the number of printing) at the image processing unit A becomes 4 (see step S61 in FIG. 15, and the following steps S62-78 are also shown in FIG. 15). Accordingly, as shown in FIGS. 16A-16D, in the same way as normal duplex printing, printing is performed on the first print surface of the three recording sheets P that are successively transported from the paper feeding cassette 22, and the three recording sheets P are transported to the circulation path 27 in order. Note that in this case, air moved by the fan 42 is blown onto a recording sheet P passing through the branch 23.

Figures 16A, 16B, 16C, 16D, 16E, 16F, 16G, 16H, 16I, 16J, 16K:
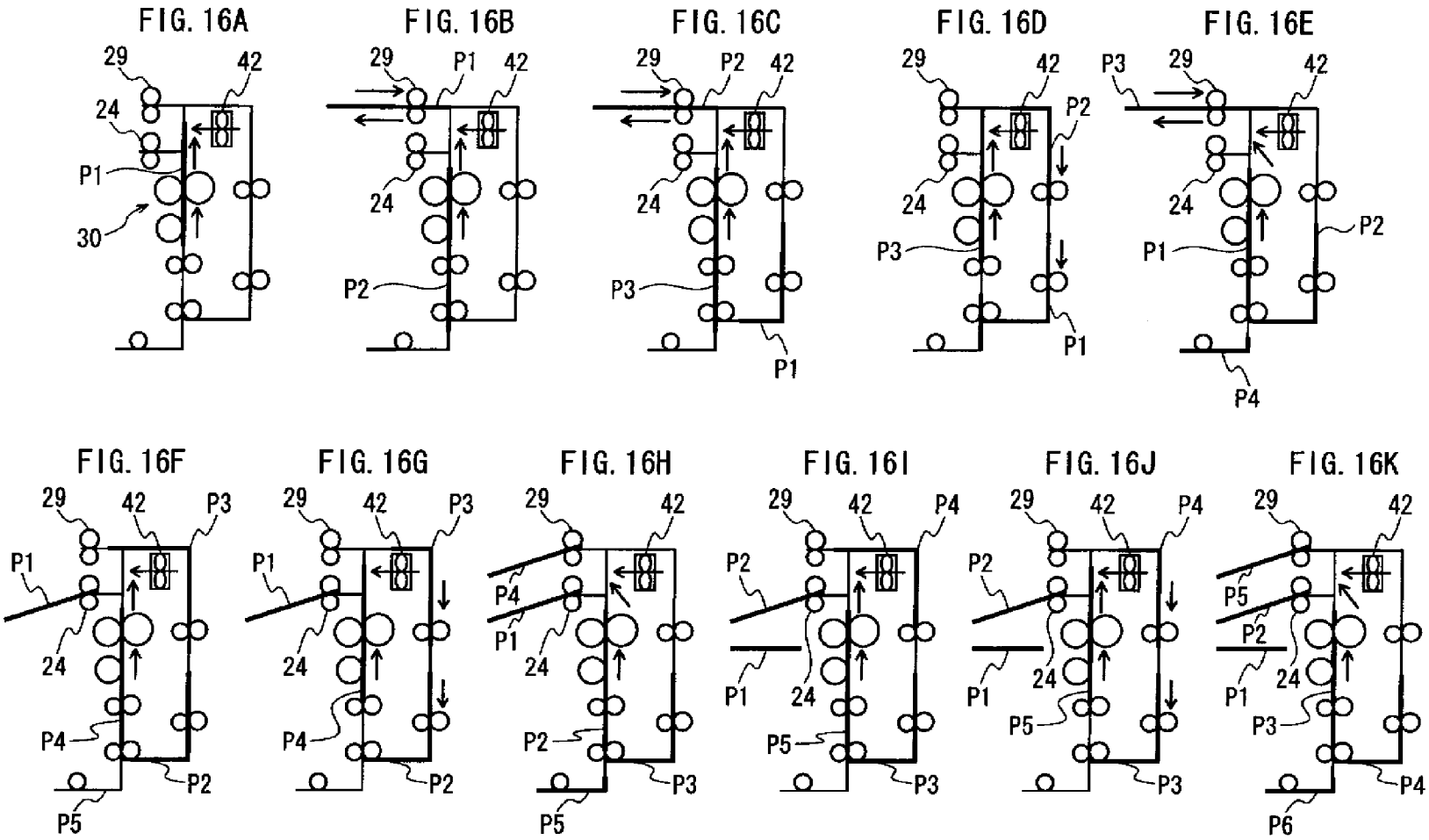
FIGS. 16A-16K are schematic views each showing a state of transporting the recording sheets in the toner drying control.

When the count value N in printing at the image processing unit A becomes 4 ("YES" in step S61), the controller 51 judges whether printing that is to be performed next at the image processing unit A is performed on the first print surface (verso side) of a recording sheet P or performed on the second print surface (recto side) of the recording sheet P (step S62). The fourth printing is, as shown in FIG. 16E, performed on the second print surface of the first recording sheet P1 ("YES" in step S62), and the processing proceeds to step S63.

In step S63, the guide switch motor 46 is inverted so that the guide member 26 guides the recording sheet P to the pair of sheet ejecting rollers 24.

Next, in the toner drying control, a control to judge whether a stopped time period during which the pair of sheet ejecting rollers 24 hold the recording sheet P needs to extend (stopped time judgment control) is performed (step S64).

The stopped time judgment control is the same procedure as the flowchart in FIG. 6 except that a calculation of stopped time period performed in step S41 of the flowchart in FIG. 6 is different.

In a calculation of a stopped time period T3 performed in step S41 in the flowchart in FIG. 6, the following function (3) is used.

$$T3=0.42\times T1+\alpha \quad (3)$$

Note that T1 is a stopped time period for a printer having "circulation path housing one recording sheet" that is shorter than the circulation path housing three recording sheets, and T1 is a reference stopped time period. The circulation path housing one recording sheet can only house one recording sheet P in the circular path from the guide member 26 through the circulation path 27 to the guide member 26. In addition, the value 0.42 in the function (3) is a predetermined constant.

The stopped time period T1 in the circulation path housing one recording sheet can be obtained using the following function (4).

$$T1=\{Lp+(2\times Lgp)+La\}/Sp+Te+\alpha \quad (4)$$

Note that Lp is a length of a recording sheet P in the transport direction and is obtained from a size of the recording sheets P, and Lgp is an interval between recording sheets P that are successively transported (see FIG. 7). La is a length of the circular path formed by the circulation path housing one recording sheet (from the guide member through the circulation path to the guide member), and Sp is a transport speed (system speed) of a recording sheet P. Te is the stopped time period of an even-numbered recording sheet, which is calculated by the above function (2).

In this case, the stopped time period T1 is a time period that elapses since the pair of sheet ejecting rollers 24 hold the rear end portion of the first recording sheet P1 and until the second recording sheet P2 passes through the circulation path 27 and reaches the pair of sheet ejecting rollers 24. Accordingly, during the stopped time period T1, normal printing is performed on the first print surface of the second recording sheet P2, and the second recording sheet P2 passes through the circulation path 27 and is transported to the pair of sheet ejecting rollers 24.

The stopped time period T3 in the circulation path housing three recording sheets is obtained by multiplying the stopped time period T1 in the circulation path housing one recording sheet by a predetermined constant (=0.42). The predetermined constant is a theoretical value obtained by calculating, in the printer including the circulation path housing three recording sheets, a time period that is required until a recording sheet P reaches the pair of sheet ejecting rollers 24 after an immediately preceding recording sheet P is held by the pair of sheet ejecting rollers 24, as a ratio to the stopped time period T1 in the circulation path housing one recording sheet.

Note that a stopped time period T2 in a printer having circulation path housing two recording sheets can be calculated by the following function (5).

$$T2=0.56\times T1+\alpha \quad (5)$$

The value 0.56 is a theoretical value obtained by calculating, in the printer including the circulation path housing two recording sheets, a time period that is required until an immediately preceding recording sheet P reaches the pair of sheet ejecting rollers 24 after a recording sheet P is held by the pair of sheet ejecting rollers 24, as a ratio to the stopped time period T1 in the circulation path housing one recording sheet.

In the printer including the circulation path housing one recording sheet, if a length L1 of a path from the guide member 26 to the pair of sheet ejecting rollers 24 is 100 mm, a length L2 of a path from the guide member 26 to the circulating rollers 29 is 100 mm, and a length La of the circular path formed by the circulation path housing three recording sheets is 1000 mm, in the case where a recording sheet P of an A4 size is transported at a transport speed of 200 mm/s while a transport direction is a longitudinal direction of the recording sheets P and duplex printing is performed, the stopped time period T1 is 8.9 seconds (note that $\alpha=0$). Note that as described above, a length Lp of the recording sheet P of the A4 size in a direction along the transport direction is 297 mm, and an interval between the transported recording sheets P is 60 mm.

Accordingly, the stopped time period T3 of the printer including the circulation path housing three recording sheets is 3.7 seconds (note that $\alpha=0$). Also, the stopped time period T2 of the printer including the circulation path housing two recording sheets is 5.0 seconds (note that $\alpha=0$).

FIG. 17 is a table showing functions (3), (4), and (5) for acquiring the above described stopped time periods T1, T2, and T3, respectively, and examples of each stopped time period T1, T2, and T3 for the recording sheet P of the A4 size.

In the stopped time period determining control in step S64 of the flowchart shown in FIG. 15, if the stopped time period T3 is calculated in step S41 of the flowchart in FIG. 6, the same procedures shown in step S42 to S44 shown in the flowchart in FIG. 6 are performed and the stopped time period determining control ends. Then the processing proceeds to step S64.

In step S64 in the flowchart shown in FIG. 15, the rotational speed determining control that determines a rotational speed of the fan 42 that moves air is performed. In this case, the control is the same as the rotational speed determining control of the fan 42 shown in FIG. 9. However, a temperature of a recording sheet is estimated based on duplex printing in graphs shown in FIG. 10 to FIG. 13.

After the rotational speed determining control of the fan 42 is performed, the processing proceeds to step S66, and immediately before the first recording sheet P1 reaches the pair of sheet ejecting rollers 24, the sheet ejecting motor 45 rotates the pair of sheet ejecting rollers 24. Then until the rear end portion of the recording sheet P reaches the pair of sheet ejecting rollers 24, the pair of sheet ejecting rollers 24 are rotated (step S67).

When the rear end portion of the recording sheet P reaches the pair of sheet ejecting rollers 24 ("YES" in step S67), the sheet ejecting motor 45 is stopped and the pair of sheet ejecting rollers 24 stop rotating so that the rear end portion of the first recording sheet P1 is held by the pair of sheet ejecting rollers 24. At the same time as this, the first timer T1 that counts stopped time period of the pair of sheet ejecting rollers 24 starts clocking a time (step S68).

When rotation of the pair of sheet ejecting rollers 24 stops, the first recording sheet P1 is positioned above the ejected-sheet tray 41 while the rear end portion of the first recording sheet P1 is held by the pair of sheet ejecting rollers 24, as shown in FIG. 16F. In this case, the fan 42 is driven at a rotational speed appropriate for drying toner on the first recording sheet P1, and accordingly air moved by the fan 42 is blown onto the first recording sheet P1 and the toner on the recording sheet P1 is efficiently dried.

After that, whether printing at the image processing unit A has completely finished or not is judged (step S69). In this case, since printing has not completely finished ("NO" in step S69), the processing returns to step S62.

Note that the case where printing has completely finished ("YES" in step S69) will be described later.

In step S62, whether printing that is to be performed next at the image processing unit A is performed on the first print surface of the recording sheet P or performed on the second print surface is judged. Printing in this case is performed on the first print surface of the fourth recording sheet P4 ("NO" in step S62). Accordingly, the processing proceeds to step S72, and the guide switch motor 46 is driven in the forward direction so that the guide member 26 guides the recording sheet P to the pair of circulating rollers 29.

Next, as shown in FIG. 16G, immediately before the fourth recording sheet P reaches the pair of circulating rollers 29, the circulation motor 46 rotates the pair of circulating rollers 29 in the forward direction (step S73). After that, until the rear end portion of the fourth recording sheet P reaches the pair of circulating rollers 29, the pair of circulating rollers 29 remain rotating in the forward direction (step S74). When the rear end portion of the recording sheet P reaches the pair of circulating rollers 29 ("YES" in step S74), rotation of the circulation motor 46 is stopped to stop rotation of the pair of circulating rollers 29 (step S75) so that the rear end portion of the fourth recording sheets P4 is held by the pair of circulating rollers 29.

After rotation of the pair of circulating rollers 29 stops, as shown in FIG. 16H, the fourth recording sheet P4 is positioned above the ejected-sheet tray 41 while the rear end portion of the fourth recording sheet P4 is being held by the pair of circulating rollers 29. In this case, the first recording sheet P1 whose rear end portion is held by the pair of sheet ejecting rollers 24 is positioned between the ejected-sheet tray 41 and the fourth recording sheet P4 whose rear end portion is held by the pair of circulating rollers 29.

In such a state, air that is moved by the fan 42 and cools the first recording sheet P1 is also blown onto the fourth recording sheet P4 held by the pair of circulating rollers 29, and accordingly the fourth recording sheet P4 is also cooled. Thereby, drying the toner formed on the first print surface of the fourth recording sheet P4 is facilitated.

After that, whether the first timer T1 that counts stopped time period of the pair of sheet ejecting rollers 24 is an up state is judged (step S76). If the first timer T1 is not in the up state ("NO" in step S76), the processing remains in a wait state until the up state. Once the first timer T1 is in the up state ("YES" in step S76), the sheet ejecting motor 45 rotates the pair of sheet ejecting rollers 24 for a predetermined time period, and at the same time, the circulation motor 46 rotates the pair of circulating rollers 29 for a predetermined time period in the reverse direction (step S77).

Thereby, the first recording sheet P1 held by the pair of sheet ejecting rollers 24 is ejected on the ejected-sheet tray 41 immediately before the second recording sheet P2 reaches the pair of sheet ejecting rollers 24, and the fourth recording sheets P4 held by the pair of circulating rollers 29 is transported to the circulation path 27 by the pair of circulating rollers 29 that rotate in the reverse direction (see FIG. 16I). After the pair of sheet ejecting rollers 24 are rotated for a predetermined time period thereof in the forward direction and the pair of circulating rollers 29 are rotated for the predetermined time periods thereof in the reverse direction, each rotation of the pair of sheet ejecting rollers 24 and the pair of circulating rollers 29 stops (step S78), and the processing returns to the step S62.

In step S62, whether printing that is to be performed next at the image processing unit A is performed on the first print surface of the recording sheet P or performed on the second print surface of the recording sheet P is judged. Printing in this case is performed on the second print surface of the second recording sheet P2 ("YES" in step S62), and the processing proceeds to step S63. Hereinafter, as procedures of steps S63 to S69 are performed, as shown in FIG. 16I, the second recording sheet P2 is held by the pair of sheet ejecting rollers 24, and the fan 42 cools the second recording sheet P2 with an amount of air that is most appropriate for the second recording sheet P2.

After that, the processing returns to step S62, processes from S72 to S78 are performed, and a state shown in FIG. 16J changes to a state shown in FIG. 16K.

Thus, once printing has completely finished, a result of step S69 is "YES". In step S70, the processing is in a wait state until the first timer T1 becomes an up state (step S70). When the first timer T1 becomes the up state ("YES" in step S70), the pair of sheet ejecting rollers 24 are rotated for a predetermined time period (step S71). Thereby, the recording sheet P held by the pair of sheet ejecting rollers 24 is ejected onto the ejected-sheet tray 41. Up to this point, the toner drying control has been explained.

As described above, in the case where printing is performed on both sides of each of recording sheets P that are successively transported, while both of the pair of sheet ejecting rollers 24 and the pair of circulating rollers 29 are holding the recording sheets P, each recording sheet P is cooled at the same time. Accordingly, a toner image on each recording sheet P can be efficiently dried. Therefore, fixing tacking is reliably prevented from occurring when each recording sheet P is ejected onto the ejected-sheet tray 41.

[Modification]

Note that the fixing device 30 is not limited to a structure forming the fixing nip N2 with use of the heating roller 32 and the pressurizing roller 33. The fixing nip N2 may be formed by (i) a belt and a roller, (ii) a belt and a belt, or (iii) a belt or a roller and a fixed member.

Moreover, the above embodiment describes the tandem type color digital printer as the image forming apparatus, but is not limited to this. The image forming apparatus may be a printer, a copy machine, a FAX, a Multiple Function Peripheral (MFP) and the like. Also, a monochrome image forming apparatus may be used.

In addition, an image forming apparatus that forms an image by ink as a developer via an ink jet method and the like may be applied to the present invention.

<Conclusion of Embodiment>

According to the image forming apparatus of the present invention, the pair of first sheet ejecting rollers and the pair of second sheet ejecting rollers hold respective recording sheets on which an image is sequentially formed with the developer at the image processing unit. Since the fan moves air past the pair of first sheet ejecting rollers and the pair of second sheet ejecting rollers toward the respective recording sheets, it is possible to dry the image on the respective recording sheets during a short time without increasing an amount of air moved by the fan. Accordingly, there is no possibility that printing efficiency and economic efficiency decrease. Moreover, there is also no possibility that a fan make an intense noise.

As described above, the present invention is useful as a technology to efficiently dry a developer when an image is formed on each of recording sheets that are successively transported.

Preferably, the image processing unit forms an image on one side of each of recording sheets that are successively transported thereto, and the controller may control the pair of first sheet ejecting rollers, the pair of second sheet ejecting rollers, and the guide member so that any odd-numbered recording sheet and any even-numbered recording sheet in an order of transport are held by the pair of first sheet ejecting rollers and the pair of second sheet ejecting rollers, respectively.

Preferably, the controller may control the pair of first sheet ejecting rollers and the pair of second sheet ejecting rollers so that the pair of first sheet ejecting rollers eject a recording sheet held thereby onto the ejected-sheet tray earlier than a recording sheet held by the pair of second sheet ejecting rollers.

Preferably, the controller may control the pair of first sheet ejecting rollers and the pair of second sheet ejecting rollers so as, to cause (i) the pair of first sheet ejecting rollers to eject a recording sheet held thereby onto the ejected-sheet tray immediately before a recording sheet that is to be next held by the pair of first sheet ejecting rollers reaches the pair of first sheet ejecting rollers, and (ii) the pair of second sheet ejecting rollers to eject a recording sheet held thereby onto the ejected-sheet tray immediately before a recording sheet that is to be next held by the pair of second sheet ejecting rollers reaches the pair of second sheet ejecting rollers.

Preferably, the pair of second sheet ejecting rollers may be a pair of circulating rollers that cause a recording sheet that has been transported from the image processing unit and held by the second sheet ejecting rollers to circulate through a circulation path and return to the image processing unit.

Preferably, the image processing unit forms an image on both sides of each of recording sheets one side at a time, the recording sheets being successively transported to the image processing unit, and the controller may control the pair of first sheet ejecting rollers, the pair of circulating rollers, and the guide member so that when a recording sheet that has an image formed on both sides thereof is being held by the pair of first sheet ejecting rollers, a recoding sheet that has an image formed on one side thereof is held by the pair of circulating rollers after a predetermined number of recording sheets are housed in the circulation path.

Preferably, the image processing unit may transfer toner images formed on a photoreceptor onto a recording sheet and fixes the transformed toner images on the recording sheet.

Preferably, the controller may control an amount of the air moved by the fan based on a temperature of a recording sheet on which an image has been fixed by the image processing unit, an amount of toner on the recording sheet, a type of the recording sheet, and a time period during which the recording sheet is held by a corresponding one of the pair of first sheet ejecting rollers and the pair of second sheet ejecting rollers.

Preferably, the temperature of the recording sheet on which the toner image has been fixed by the image processing unit may depend on an ambient temperature, a fixing temperature, whether the toner image is formed on one side or both sides of the recording sheet, whether the toner image is a full-color image or a monochrome image, and the type of the recording sheet.

Although the present invention has been fully described by way of examples with reference to the accompanying drawings, it is to be noted that various changes and modifications will be apparent to those skilled in the art. Therefore, unless such changes and modifications depart from the scope of the present invention, they should be constructed as being included therein.

What is claimed is:

1. An image forming apparatus including an image processing unit and an ejected-sheet tray, the image forming apparatus comprising:

a pair of first sheet ejecting rollers and a pair of second sheet ejecting rollers that eject, onto the ejected-sheet tray, a recording sheet on which an image is formed by the image processing unit with use of a developer, the pair of second sheet ejecting rollers being positioned above the pair of first sheet ejecting rollers;

a guide member that selectively guides the recording sheet to the pair of first sheet ejecting rollers or the pair of second sheet ejecting rollers;

a controller that controls the pair of first sheet ejecting rollers, the pair of second sheet ejecting rollers, and the guide member so that, while a recording sheet that is to be ejected by the pair of first sheet ejecting rollers onto the ejected-sheet tray is being held by the pair of first sheet ejecting rollers in a stopped state, the pair of second sheet ejecting rollers is in a stopped state and hold an immediately subsequent recording sheet transported from the image processing unit above the ejected-sheet tray; and a fan that moves air past the pair of first sheet ejecting rollers and the pair of second sheet ejecting rollers toward the recording sheet held by the pair of first sheet ejecting rollers and the immediately subsequent recording sheet held by the pair of second sheet ejecting rollers.

2. The image forming apparatus of claim 1, wherein the image processing unit forms an image on one side of each of recording sheets that are successively transported thereto, and the controller controls the pair of first sheet ejecting rollers, the pair of second sheet ejecting rollers, and the guide member so that any odd-numbered recording sheet and any even-numbered recording sheet in an order of transport are held by the pair of first sheet ejecting rollers and the pair of second sheet ejecting rollers, respectively.

3. The image forming apparatus of claim 2, wherein the controller controls the pair of first sheet ejecting rollers and the pair of second sheet ejecting rollers so that the pair of first sheet ejecting rollers eject a recording sheet held thereby onto the ejected-sheet tray earlier than a recording sheet held by the pair of second sheet ejecting rollers.

4. The image forming apparatus of claim 1, wherein the controller controls the pair of first sheet ejecting rollers and the pair of second sheet ejecting rollers so as to cause (i) the pair of first sheet ejecting rollers to eject a recording sheet held thereby onto the ejected-sheet tray immediately before a recording sheet that is to be next held by the pair of first sheet ejecting rollers reaches the pair of first sheet ejecting rollers, and (ii) the pair of second sheet ejecting rollers to eject a recording sheet held thereby onto the ejected-sheet tray immediately before a recording sheet that is to be next held by the pair of second sheet ejecting rollers reaches the pair of second sheet ejecting rollers.

5. The image forming apparatus of claim 1, wherein the pair of second sheet ejecting rollers are a pair of circulating rollers that cause a recording sheet that has been transported from the image processing unit and held by the second sheet ejecting rollers to circulate through a circulation path and return to the image processing unit.

6. The image forming apparatus of claim 5, wherein the image processing unit forms an image on both sides of each of recording sheets one side at a time, the recording sheets being successively transported to the image processing unit, and the controller controls the pair of first sheet ejecting rollers, the pair of circulating rollers, and the guide member so that when a recording sheet that has an image formed on both sides thereof is being held by the pair of first sheet ejecting rollers, a recoding sheet that has an image formed on one side thereof is held by the pair of circulating rollers after a predetermined number of recording sheets are housed in the circulation path.

7. The image forming apparatus of claim 1, wherein the image processing unit transfers toner images formed on a photoreceptor onto a recording sheet and fixes the transformed toner images on the recording sheet.

8. The image forming apparatus of claim 7, wherein the controller controls an amount of the air moved by the fan based on a temperature of a recording sheet on which an image has been fixed by the image processing unit, an amount of toner on the recording sheet, a type of the recording sheet, and a time period during which the recording sheet is held by a corresponding one of the pair of first sheet ejecting rollers and the pair of second sheet ejecting rollers, wherein a terminal apparatus provides information of the type to the controller.

9. The image forming apparatus of claim 8, wherein the temperature of the recording sheet on which the toner image has been fixed by the image processing unit depends on an ambient temperature, a fixing temperature, whether the toner image is formed on one side or both sides of the recording sheet, whether the toner image is a full-color image or a monochrome image, and the type of the recording sheet.

* * * * *